US012274926B2

(12) United States Patent
Taylor et al.

(10) Patent No.: US 12,274,926 B2
(45) **Date of Patent: *Apr. 15, 2025**

(54) GOLF CLUB AND GOLF CLUB HEAD STRUCTURES

(71) Applicant: Karsten Manufacturing Corporation, Phoenix, AZ (US)

(72) Inventors: Michael G. Taylor, Granbury, TX (US); Michael Wallans, Portland, OR (US); John T. Stites, Sallisaw, OK (US); Sherry L. Jones, Pataskala, OH (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/168,895

(22) Filed: Feb. 14, 2023

(65) Prior Publication Data

US 2023/0191213 A1 Jun. 22, 2023

Related U.S. Application Data

(63) Continuation of application No. 17/443,104, filed on Jul. 20, 2021, now Pat. No. 11,577,133, which is a (Continued)

(51) Int. Cl.
*A63B 53/06* (2015.01)
*A63B 53/04* (2015.01)
(Continued)

(52) U.S. Cl.
CPC ..... *A63B 60/00* (2015.10); *A63B 53/0466* (2013.01); *A63B 53/06* (2013.01);
(Continued)

(58) Field of Classification Search
CPC ..... A63B 53/0433; A63B 53/0437; A63B 53/047; A63B 2053/0491
See application file for complete search history.

(56) References Cited

U.S. PATENT DOCUMENTS 1,531,821 A 3/1925 Scott
2,163,091 A 6/1939 Held
(Continued)

FOREIGN PATENT DOCUMENTS

CN 2551285 5/2003
CN 102218209 10/2011
(Continued)

*Primary Examiner* — Alvin A Hunter

(57) ABSTRACT

A golf club head has a body having a ball striking face, a rear opposite the ball striking face, a crown, a sole, a heel, and a toe, the body having a void defined by a peripheral edge on the sole. The body further defines a cover that extends over the void and forms at least a portion of the crown. At least a portion of the peripheral edge of the void includes a lip extending from the peripheral edge inwardly into the void. The golf club head may additionally or alternately include one or more weight receptacles connected to the sole and having an opening in the sole, such that each weight receptacle is configured to receive insertion of a weight through the opening.

18 Claims, 11 Drawing Sheets

Related U.S. Application Data continuation of application No. 16/896,080, filed on Jun. 8, 2020, now Pat. No. 11,065,517, which is a continuation of application No. 16/377,067, filed on Apr. 5, 2019, now Pat. No. 10,675,520, which is a continuation of application No. 15/723,381, filed on Oct. 3, 2017, now Pat. No. 10,258,849, which is a continuation of application No. 14/564,984, filed on Dec. 9, 2014, now Pat. No. 9,795,845, which is a continuation-in-part of application No. 13/593,253, filed on Aug. 23, 2012, now Pat. No. 9,433,834, which is a continuation-in-part of application No. 13/250,051, filed on Sep. 30, 2011, now Pat. No. 8,668,595, and a continuation-in-part of application No. 12/723,951, filed on Mar. 15, 2010, now abandoned, which is a continuation-in-part of application No. 12/356,176, filed on Jan. 20, 2009, now Pat. No. 7,922,603.

(60) Provisional application No. 61/598,832, filed on Feb. 14, 2012, provisional application No. 61/526,326, filed on Aug. 23, 2011, provisional application No. 61/480,322, filed on Apr. 28, 2011.

(51) Int. Cl.

| | |
|---|---|
| ***A63B 60/00*** | (2015.01) |
| ***A63B 60/02*** | (2015.01) |
| ***A63B 60/52*** | (2015.01) |
| *A63B 60/54* | (2015.01) |

(52) U.S. Cl.

CPC ..... *A63B 60/02* (2015.10); *A63B 60/52* (2015.10); *A63B 60/54* (2015.10)

(56) References Cited

U.S. PATENT DOCUMENTS

| | | | |
|---|---|---|---|
| 3,166,320 | A | 1/1965 | Onions |
| 3,374,027 | A | 3/1968 | Jacobs |
| 3,966,210 | A | 6/1976 | Rozmus |
| 3,976,299 | A | 8/1976 | Lawrence |
| 4,010,958 | A | 3/1977 | Long |
| 4,052,075 | A | 10/1977 | Daly |
| 4,390,184 | A | 6/1983 | Rudell |
| 4,431,192 | A | 2/1984 | Stuff, Jr. |
| 4,444,392 | A | 4/1984 | Duclos |
| D275,590 | S | 9/1984 | Duclos |
| 4,653,756 | A | 3/1987 | Sato |
| 4,741,535 | A | 5/1988 | Leonhardt |
| 4,811,949 | A | 3/1989 | Kobayashi |
| 4,871,174 | A | 10/1989 | Kobayashi |
| 4,895,371 | A | 1/1990 | Bushner |
| D326,130 | S | 5/1992 | Chorne |
| 5,186,465 | A | 2/1993 | Chorne |
| 5,211,401 | A | 5/1993 | Hainey |
| 5,335,914 | A | 8/1994 | Long |
| 5,340,104 | A | 8/1994 | Griffin |
| D354,103 | S | 1/1995 | Allen |
| 5,397,126 | A | 3/1995 | Allen |
| 5,407,196 | A | 4/1995 | Busnardo |
| 5,429,366 | A | 7/1995 | McCabe |
| 5,456,464 | A | 10/1995 | Davenport |
| 5,464,217 | A | 11/1995 | Shenoha |
| 5,476,262 | A | 12/1995 | Bandiero |
| 5,497,995 | A | 3/1996 | Swisshelm |
| 5,518,242 | A | 5/1996 | Mahaffey |
| 5,533,725 | A | 7/1996 | Reynolds, Jr. |
| 5,547,427 | A | 8/1996 | Rigal |
| 5,580,058 | A | 12/1996 | Coughlin |
| 5,607,365 | A | 3/1997 | Wolf |
| D381,382 | S | 7/1997 | Fenton, Jr. |
| 5,692,968 | A | 12/1997 | Shine |
| 5,709,613 | A | 1/1998 | Sheraw |
| D392,007 | S | 3/1998 | Fox |
| 5,769,736 | A | 6/1998 | Sato |
| D397,387 | S | 8/1998 | Allen |
| D399,274 | S | 10/1998 | Bradford |
| 5,820,481 | A | 10/1998 | Raudman |
| 5,888,148 | A | 3/1999 | Allen |
| D414,234 | S | 9/1999 | Darrah |
| 6,015,354 | A | 1/2000 | Ahn |
| D422,041 | S | 3/2000 | Bradford |
| 6,270,422 | B1 | 8/2001 | Fisher |
| RE37,647 | E | 4/2002 | Wolf |
| 6,394,910 | B1 | 5/2002 | McCarthy |
| 6,402,638 | B1 | 6/2002 | Kelley |
| D465,251 | S | 11/2002 | Wood |
| D470,553 | S | 2/2003 | Helmstetter |
| 6,558,271 | B1 | 5/2003 | Beach |
| 6,623,374 | B1 | 9/2003 | Helmstetter |
| 6,634,956 | B1 | 10/2003 | Pegg |
| 6,652,390 | B2 | 11/2003 | Bradford |
| 6,663,503 | B1 | 12/2003 | Kenmi |
| D484,937 | S | 1/2004 | Madore |
| 6,767,292 | B1 | 7/2004 | Skalla, Sr. |
| D502,973 | S | 3/2005 | Gillig |
| 6,878,071 | B1 | 4/2005 | Schwieger |
| 6,958,019 | B2 | 10/2005 | Rohrer |
| 6,991,555 | B2 | 1/2006 | Reese |
| 7,018,304 | B2 | 3/2006 | Bradford |
| 7,070,515 | B1 | 7/2006 | Liu |
| 7,128,660 | B2 | 10/2006 | Gillig |
| D532,855 | S | 11/2006 | Madore |
| 7,147,569 | B2 | 12/2006 | Tang |
| 7,201,668 | B1 | 4/2007 | Pamias |
| 7,255,653 | B2 | 8/2007 | Saso |
| D551,310 | S | 9/2007 | Kuan |
| 7,297,073 | B2 | 11/2007 | Jung |
| 7,326,121 | B2 | 2/2008 | Roake |
| 7,331,876 | B2 | 2/2008 | Klein |
| 7,351,161 | B2 | 4/2008 | Beach |
| D568,955 | S | 5/2008 | Oldknow |
| 7,398,153 | B2 | 7/2008 | Workman |
| 7,407,443 | B2 | 8/2008 | Franklin |
| 7,431,660 | B2 | 10/2008 | Hasegawa |
| 7,431,663 | B2 | 10/2008 | Pamias |
| 7,520,820 | B2 | 4/2009 | DiMarco |
| 7,722,478 | B2 | 5/2010 | Ebner |
| 7,736,242 | B2 | 6/2010 | Stites |
| D619,666 | S | 7/2010 | DePaul |
| 7,753,809 | B2 | 7/2010 | Cackett |
| 7,771,285 | B2 | 8/2010 | Porter |
| 7,803,066 | B2 | 9/2010 | Solheim |
| 7,918,745 | B2 | 4/2011 | Morris |
| 7,922,596 | B2 | 4/2011 | Vanderbilt |
| 7,922,603 | B2 | 4/2011 | Boyd |
| 7,959,519 | B2 | 6/2011 | Zielke |
| 7,959,523 | B2 | 6/2011 | Rae |
| 7,993,211 | B2 | 8/2011 | Bardha |
| 7,993,213 | B1 | 8/2011 | D'Eath |
| 8,007,371 | B2 | 8/2011 | Breier |
| 8,025,586 | B2 | 9/2011 | Teramoto |
| 8,043,166 | B2 | 10/2011 | Cackett |
| 8,100,779 | B2 | 1/2012 | Solheim |
| 8,177,664 | B2 | 5/2012 | Horii |
| 8,251,836 | B2 | 8/2012 | Brandt |
| 8,303,434 | B1 | 11/2012 | DePaul |
| 8,337,335 | B2 | 12/2012 | Dugan |
| D679,354 | S | 4/2013 | Oldknow |
| 8,430,764 | B2 | 4/2013 | Bennett |
| 8,435,134 | B2 | 5/2013 | Tang |
| 8,540,589 | B2 | 9/2013 | Bezilla |
| 8,591,352 | B2 | 11/2013 | Hirano |
| 8,628,433 | B2 | 1/2014 | Stites |
| 8,734,265 | B2 | 5/2014 | Soracco |
| D707,769 | S | 6/2014 | Oldknow |
| D707,773 | S | 6/2014 | Oldknow |
| 8,753,224 | B1 | 6/2014 | Kim |
| D709,575 | S | 7/2014 | Oldknow |
| 8,790,195 | B1 | 7/2014 | Myers |
| 8,834,294 | B1 | 9/2014 | Seluga |

(56) References Cited

U.S. PATENT DOCUMENTS

| | | | | |
|---|---|---|---|---|
| D722,353 | S | 2/2015 | Cardani | |
| D723,122 | S | 2/2015 | Cardani | |
| 8,961,332 | B2 | 2/2015 | Galvan | |
| 9,028,342 | B2 | 5/2015 | Stites | |
| 9,044,660 | B2 | 6/2015 | Selfridge | |
| 9,067,110 | B1 | 6/2015 | Seluga | |
| 9,114,293 | B2 | 8/2015 | Soracco | |
| 9,144,717 | B2 | 9/2015 | Franklin | |
| 9,149,693 | B2 | 10/2015 | Stites | |
| 9,155,944 | B2 | 10/2015 | Stites | |
| 9,168,435 | B1 | 10/2015 | Boggs | |
| 9,192,831 | B2 | 11/2015 | Stites | |
| 9,211,452 | B2 | 12/2015 | Bennett | |
| 9,289,661 | B2 | 3/2016 | Stites | |
| 9,320,957 | B2 | 4/2016 | Bentley | |
| 9,433,834 | B2 | 9/2016 | Stites | |
| 9,446,294 | B2 | 9/2016 | Oldknow | |
| 9,604,108 | B1 | 3/2017 | Dunnell | |
| 9,795,845 | B2 | 10/2017 | Taylor | |
| 9,943,733 | B2 | 4/2018 | Franklin | |
| 9,950,219 | B2 | 4/2018 | Larson | |
| 10,130,854 | B2 | 11/2018 | Stites | |
| 10,220,271 | B2 | 3/2019 | Larson | |
| 10,363,465 | B2 | 7/2019 | Stites | |
| 10,780,330 | B2 | 9/2020 | Stites | |
| 11,065,517 | B2 * | 7/2021 | Taylor | A63B 60/52 |
| 11,577,133 | B2 * | 2/2023 | Taylor | A63B 60/52 |
| 2002/0137576 | A1 | 9/2002 | Dammen | |
| 2003/0045371 | A1 | 3/2003 | Wood | |
| 2003/0195055 | A1 | 10/2003 | Helmstetter | |
| 2004/0116200 | A1 | 6/2004 | Helmstetter | |
| 2005/0032584 | A1 | 2/2005 | Van Nimwegen | |
| 2006/0025229 | A1 | 2/2006 | Mahajan | |
| 2007/0111811 | A1 | 5/2007 | Grober | |
| 2011/0152001 | A1 | 6/2011 | Hirano | |

FOREIGN PATENT DOCUMENTS

| | | |
|---|---|---|
| EP | 0101426 | 2/1984 |
| EP | 2377586 | 10/2011 |
| JP | S6443278 | 2/1989 |
| JP | 07255886 | 10/1995 |
| JP | 8155063 | 6/1996 |
| JP | 8252343 | 10/1996 |
| JP | 947528 | 2/1997 |
| JP | 09047528 | 2/1997 |
| JP | H10500875 | 1/1998 |
| JP | 0137374 | 5/1998 |
| JP | 0277180 | 10/1998 |
| JP | 1155985 | 6/1999 |
| JP | 1169491 | 6/1999 |
| JP | 2003236025 | 8/2003 |
| JP | 2004159680 | 6/2004 |
| JP | 2005046442 | 2/2005 |
| JP | 3799689 | 7/2006 |
| JP | 2006288793 | 10/2006 |
| JP | 2007267777 | 10/2007 |
| JP | 2008036315 | 2/2008 |
| JP | 2008126081 | 6/2008 |
| JP | 2010148652 | 7/2010 |
| JP | 2010148653 | 7/2010 |
| JP | 2012135366 | 7/2012 |

* cited by examiner

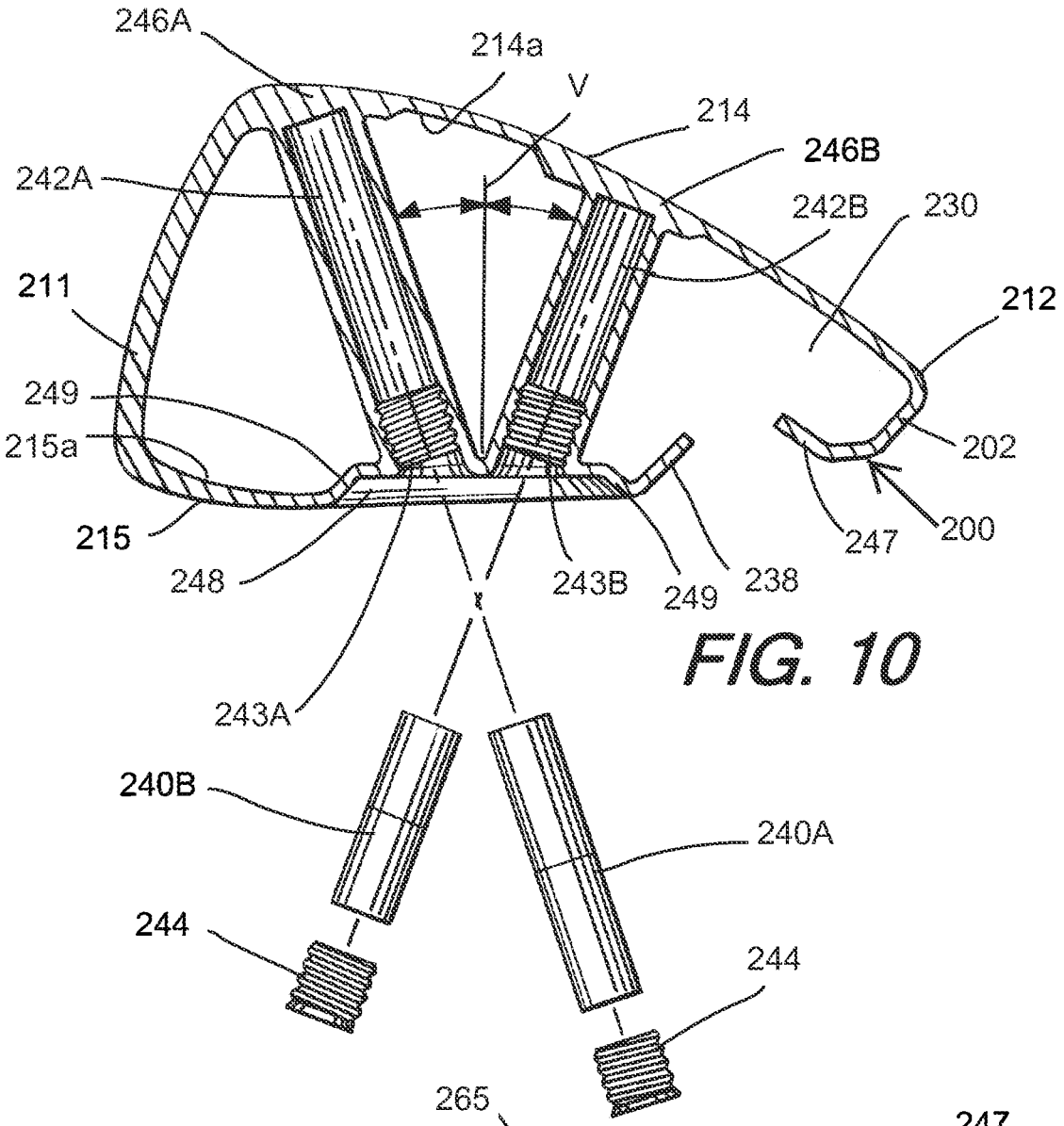
FIG. 10
FIG. 11
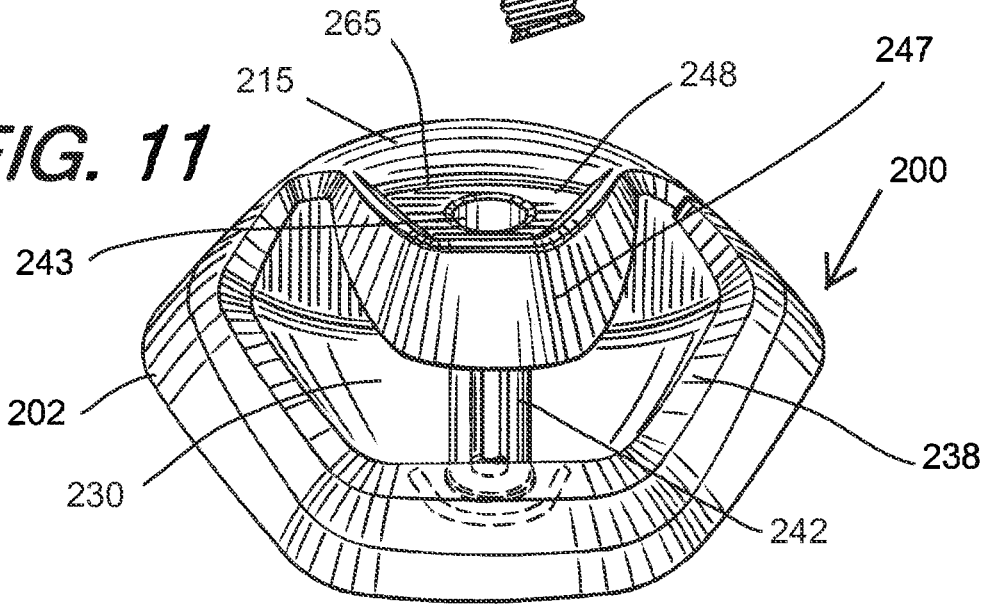

GOLF CLUB AND GOLF CLUB HEAD STRUCTURES

CROSS-REFERENCE TO RELATED APPLICATIONS

This is a continuation of U.S. patent application Ser. No. 17/443,104 filed Jul. 20, 2021, now U.S. Pat. No. 11,577,133 issued on Feb. 14, 2023, which is a continuation of U.S. patent application Ser. No. 16/896,080 filed Jun. 8, 2020, now U.S. Pat. No. 11,065,517 issued on Jul. 20, 2021, which is a continuation of U.S. patent application Ser. No. 16/377,067 filed Apr. 5, 2019, now U.S. Pat. No. 10,675,520 issued Jun. 9, 2020, which is a continuation of U.S. patent application Ser. No. 15/723,381 filed Oct. 3, 2017, now U.S. Pat. No. 10,258,849 issued Apr. 16, 2019, which is a continuation of U.S. patent application Ser. No. 14/564,984, filed Dec. 9, 2014, now U.S. Pat. No. 9,795,845, issued Oct. 24, 2017, which is a continuation-in-part of U.S. patent application Ser. No. 13/593,253, filed Aug. 23, 2012, and now U.S. Pat. No. 9,433,834, issued on Sep. 6, 2016, which claims the benefit of U.S. Provisional Application No. 61/598,832, filed on Feb. 14, 2012, and also claims the benefit of U.S. Provisional Application No. 61/526,326, filed on Aug. 23, 2011, and is also a continuation-in-part of U.S. patent application Ser. No. 13/250,051, filed on Sep. 30, 2011, now U.S. Pat. No. 8,668,595, issued on Mar. 11, 2014, which claims the benefit of U.S. Provisional Application No. 61/480,332, filed Apr. 28, 2011. U.S. application Ser. No. 13/250,051 is also a continuation-in-part of U.S. patent application Ser. No. 12/723,951, filed on Mar. 15, 2010, which is a continuation-in-part of U.S. patent application Ser. No. 12/356,176, filed on Jan. 20, 2009, now U.S. Pat. No. 7,922,603, issued on Apr. 12, 2011, the content of all of the applications discussed above are incorporated by reference herein and made part hereof.

TECHNICAL FIELD

Aspects of this invention relate generally to golf clubs and golf club heads, and, in particular, to golf clubs and golf club heads having a portion of the club head removed or open, thereby creating a void in the club head, in order to reduce or redistribute weight associated with the club head to enhance performance.

BACKGROUND

Golf is enjoyed by a wide variety of players, players of different genders and players of dramatically different ages and/or skill levels. Golf club designers have successfully advanced the technology incorporated in golf clubs in response to the constant demand of golfers for improved performance. In one aspect, golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

Also, the performance of a golf club can vary based on several factors, including weight distribution about the club head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Weight distribution about the club head can also affect moment of inertia associated with the club head. Thus, altering the moment of inertia can affect how the golf club performs including how the golf club head design impacts heel and toe mishits. Similarly, other factors such as point of impact and launch angle can also affect how the ball travels once it has been struck.

Club designers are often looking for new ways to distribute or redistribute weight associated with a golf club and/or golf club head. For instance, club designers are often looking to distribute weight to provide more forgiveness in a club head, improved accuracy, a desired ball flight and the like. In pursuit of such designs, club designers also face a challenge of maintaining a club head having a traditional aesthetic look desired by most golfers. While certain golf club and golf club head designs according to the prior art provide a number of advantageous features, they nevertheless have certain limitations. Accordingly, it would be advantageous to provide a golf club and golf club head having a reduced weight characteristic and improved weight distribution throughout the club head to enhance club performance. The present invention is provided to overcome certain of the limitations and drawbacks of the prior art, and to provide new features not heretofore available.

BRIEF SUMMARY

At least some aspects of the disclosure relate to golf clubs and golf club heads having enhanced weight distribution about the club head. In one aspect, the golf club utilizes a geometric weight feature in the form of a void formed in the golf club head. The golf club head may include a cover extending over the void such that the void may not be visible from a top of the golf club head at an address position. The golf club head may further include one or more adjustable weight arrangements.

Aspects of the invention relate to a golf club head that includes a body having a ball striking face, a rear opposite the ball striking face, a crown, a sole, a heel, and a toe. The body has a void defined by a peripheral edge on the sole, and the body further defines a cover that extends over the void and forms at least a portion of the crown. At least a portion of the peripheral edge of the void includes a lip extending from the peripheral edge inwardly into the void. The lip may extend around the entire peripheral edge, or may only extend around portions of the peripheral edge.

According to one aspect, the head includes a weight receptacle connected to the sole and having an opening in the sole, such that the weight receptacle is configured to receive insertion of a weight through the opening. The weight receptacle may be a receiving tube connected to an underside of the crown and an upper side of the sole and extending from the crown to the sole. A weight may be received in the receiving tube, and the weight may have a heavier portion and a lighter portion. In this configuration, the weight is removable and insertable in the receiving tube in multiple positions to adjust weighting characteristics of the head. The receiving tube may contain threading proximate the opening, and a threaded fastener may be provided to be releasably engaged with the threading in the receiving tube to retain the weight in the receiving tube. The sole may also have a recessed area that is recessed inwardly with respect to adjacent areas of the sole, and wherein the recessed area surrounds the opening.

According to another aspect, the head may include at least one wall extending from the top to the sole and from the heel to the toe of the body to define a completely enclosed interior cavity between the at least one wall and the face, such that the wall(s) separate the void from the interior cavity. In a head with a weight receptacle, the head may include a first wall extending from the top to the sole and extending from the weight receptacle to the toe of the body and a second wall extending from the top to the sole and extending from the weight receptacle to the heel of the body. The first and second walls define the completely enclosed interior cavity between the first and second walls and the face, and first and second walls separate the void from the interior cavity.

According to a further aspect, the peripheral edge defines the void in a U-shaped configuration, having a heel portion and a toe portion extending from proximate the rear of the body toward the face, and a connecting portion that connects the heel portion and the toe portion proximate the rear of the body. The void defines a peninsula on the sole extending rearwardly from a point proximate the face, such that the heel portion and the toe portion are positioned on opposite sides of the peninsula. The lip may extend at least around the entire peninsula.

Additional aspects of the invention relate to a golf club head that includes a body having a ball striking face, a rear opposite the ball striking face, a crown, a sole, a heel, and a toe, and a weight receptacle connected to the sole and having an opening in the sole, such that the weight receptacle is configured to receive insertion of a weight through the opening. The body has a void defined by a peripheral edge on the sole, and the body further defines a cover that extends over the void and forms at least a portion of the crown. The weight receptacle is a receiving tube connected to an underside of the crown and an upper side of the sole and extending from the crown to the sole, where at least a portion of an exterior surface of the receiving tube is exposed to the void. The head may further contain any aspects and features described above, including a lip extending around at least a portion of the void.

According to one aspect, a weight may be received in the receiving tube, and the weight may have a heavier portion and a lighter portion. In this configuration, the weight is removable and insertable in the receiving tube in multiple positions to adjust weighting characteristics of the head. The receiving tube may include threading proximate the opening, and a threaded fastener may be provided to be is releasably engaged with the threading in the receiving tube to retain the weight in the receiving tube.

According to another aspect, a first wall extends from the top to the sole and extends from the receiving tube to the toe of the body, and a second wall extends from the top to the sole and extends from the receiving tube to the heel of the body. The first and second walls define a completely enclosed interior cavity between the first and second walls and the face, and the first and second walls separate the void from the interior cavity.

According to a further aspect, the receiving tube may be aligned with a vertical axis of the golf club head or may alternately be angled with respect to a vertical axis of the golf club head.

According to yet another aspect, the head also includes a second weight receptacle connected to the sole and having a second opening in the sole, such that the second weight receptacle is configured to receive insertion of a second weight through the second opening. The second weight receptacle is a second receiving tube connected to the underside of the crown and the upper side of the sole and extending from the crown to the sole. The first and second weight receptacles are oriented at an oblique angle to each other. Weights may be received in each receiving tube, and each weight may have a heavier portion and a lighter portion, where the weights are removable and insertable in multiple positions in the respective receiving tubes to adjust weighting characteristics of the head.

Further aspects of the invention relate to a golf club head that includes a body having a ball striking face, a rear opposite the ball striking face, a crown, a sole, a heel, a toe, and an interface area proximate a central region of the body, a first weight receptacle connected to the sole and having a first opening in the sole proximate the interface area, and a second weight receptacle connected to the sole and having a second opening in the sole proximate the interface area. The body further has a first leg extending away from the interface area toward the rear and the heel and a second leg extending away from the interface area toward the rear and the toe, wherein a void is defined between the first leg and the second leg. The first weight receptacle is configured to receive insertion of a first weight through the first opening, and the first weight receptacle extends from the first opening toward the rear and the heel along the first leg. The second weight receptacle is configured to receive insertion of a second weight through the second opening, and the second weight receptacle extends from the second opening toward the rear and the heel along the second leg. Each weight receptacle may be a cylindrical receiving tube. The head may further contain any aspects and features described above.

According to one aspect, cylindrical weights are received in each receptacle. Each weight may have a heavier portion and a lighter portion, such that the weights are removable and insertable in multiple positions in the respective receptacles to adjust weighting characteristics of the head. Each receptacle may have threading proximate the opening, and threaded fasteners may be releasably engaged with the threading in to retain the weights in the receptacles.

According to another aspect, the body may further include a first recessed area on the first leg that is recessed inwardly with respect to adjacent areas of the sole, where the first recessed area surrounds the first opening, as well as a second recessed area on the second leg that is recessed inwardly with respect to adjacent areas of the sole, where the second recessed area surrounds the second opening. The body may also have a flattened keel on the sole at the interface area. The interface area may further include a sloping planar central surface located between the two legs and extending inwardly from the sole to an underside of the crown and two sloping planar side surfaces located on opposed sides of the central surface and oriented at obtuse angles to the central surface, where the side surfaces extend inwardly from the keel to the first and second recessed areas.

Still further aspects of the invention relate to a golf club head that includes a body having a ball striking face, a rear opposite the ball striking face, a crown, a sole, a heel, and a toe, a first weight receptacle connected to the sole and having a first opening in the sole proximate a central region of the body, a second weight receptacle connected to the sole and having a second opening proximate the rear of the body. The first weight receptacle is configured to receive insertion of a first weight through the first opening, and the first weight receptacle is a first receiving tube connected to the sole and extending inwardly from the sole toward the crown. The second weight receptacle is configured to receive insertion of a second weight through the second opening, and the second weight receptacle is a second receiving tube connected to the sole and extending forwardly from the rear of the body toward the face. The head may further contain any aspects and features described above.

According to one aspect, the body also includes an interface area proximate the central region of the body, where the first receiving tube is located at the interface area. The body may further have a first leg extending away from the interface area toward the rear and the heel and a second leg extending away from the interface area toward the rear and the toe, where a void is defined between the first leg and the second leg. In this configuration, the second receiving tube may extend rearwardly from the interface area between the first and second legs. Further, the body may include a rear rim that extends between the legs and around a portion of the rear of the body, such that the rear rim combines with the legs and the interface area to define the void. In this configuration, the rear rim may support and suspend an open end of the second receiving tube and the interface area may support and suspend a closed end of the second receiving tube, such that the second receiving tube is suspended within the void.

According to one aspect, cylindrical weights are received in each receptacle. Each weight may have a heavier portion and a lighter portion, such that the weights are removable and insertable in multiple positions in the respective receptacles to adjust weighting characteristics of the head. Each receptacle may have threading proximate the opening, and threaded fasteners may be releasably engaged with the threading in to retain the weights in the receptacles. The weight in the first receptacle may be configured for adjusting the weighting characteristics of the club head in a crown-sole direction, and the weight in the second receptacle may be configured for adjusting the weighting characteristics of the club head in a front-rear direction. Each tube may have threading proximate the opening, and threaded fasteners may be releasably engaged with the threading in to retain the weights in the receptacles.

According to another aspect, the first receiving tube has a first axis and the second receiving tube has a second axis, and the first and second axes are perpendicular.

Other aspects of the invention relate to a golf club that includes a golf club head as described above and a shaft connected to the golf club head.

These and additional features and advantages disclosed here will be further understood from the following detailed disclosure of certain embodiments.

BRIEF DESCRIPTION OF THE DRAWINGS

To allow for a more full understanding of the present invention, it will now be described by way of example, with reference to the accompanying drawings in which:

FIG. 10 is a cross-sectional view of another example embodiment of a golf club head with an adjustable weight arrangement according to one or more aspects described herein, illustrating the insertion of two weights into two receivers in the head;

FIG. 11 is a rear view of another example embodiment of a golf club head with an adjustable weight arrangement according to one or more aspects described herein;

Figure 1A:
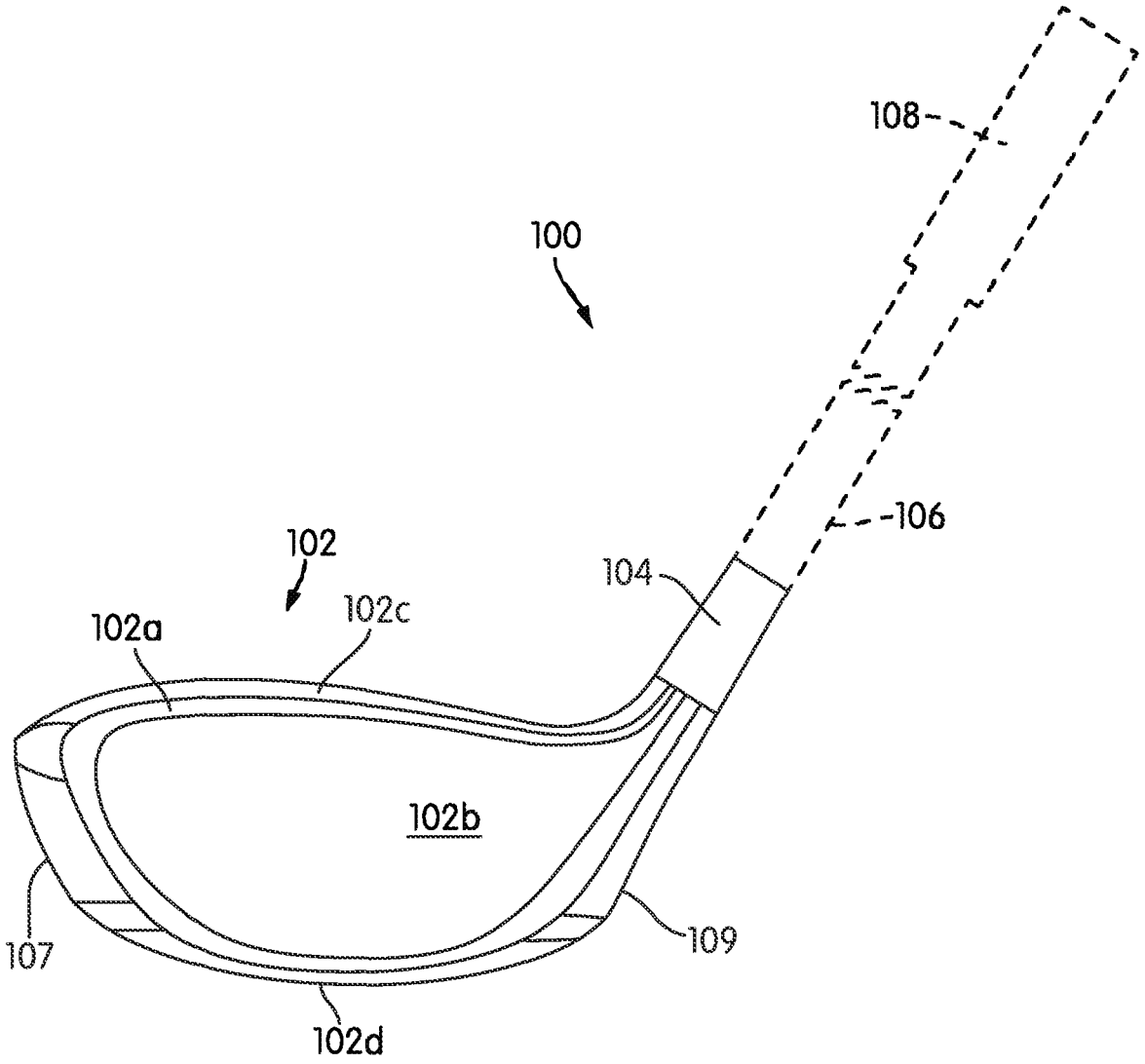
FIGS. 1A and 1B illustrate example golf club and golf club head structures according to one or more aspects described herein.

The figures referred to above are not drawn necessarily to scale, should be understood to provide a representation of particular embodiments of the invention, and are merely conceptual in nature and illustrative of the principles involved. Some features of the golf club and golf club head structures depicted in the drawings have been enlarged or distorted relative to others to facilitate explanation and understanding. In certain instances, the same reference numbers are used in the drawings for similar or identical components and features shown in various alternative embodiments. Golf clubs and golf club head structures as described herein may have configurations and components determined, in part, by the intended application and environment in which they are used.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to wood-type golf clubs. In particular, the club heads disclosed herein will be drivers and fairway woods in exemplary embodiments. However, aspects of the invention may be used with any of several types of golf clubs, including hybrid type golf clubs, utility clubs, putters, and the like and nothing in the specification or figures should be construed to limit the invention to use with the wood-type golf clubs described.

FIG. 1 generally illustrates an example golf club 100 and/or golf club head 102 in accordance with this invention. In addition to the golf club head 102, the overall golf club structure 100 of this example includes a hosel 104, a shaft 106 received in and/or inserted into and/or through the hosel 104, and a grip or handle 108 attached to the shaft 106. Optionally, if desired, the external hosel 104 may be eliminated and the shaft 106 may be directly inserted into and/or otherwise attached to the head 102 (e.g., through an opening provided in the top of the club head 102, through an internal hosel (e.g., provided within an interior chamber defined by the club head 102), etc.). The hosel 104 may be considered to be an integral part of the golf club head 102 or could also be a separate structure attached to the golf club head 102.

The shaft 106 may be received in, engaged with, and/or attached to the club head 102 in any suitable or desired manner, including in conventional manners known and used in the art, without departing from the invention. As more specific examples, the shaft 106 may be engaged with the club head 102 via the hosel 104 and/or directly to the club head structure 102, e.g., via adhesives, cements, welding, soldering, mechanical connectors (such as threads, retaining elements, or the like) and further including releasable adjustable members or connectors, etc.; through a shaft-receiving sleeve or element extending into the body of the club head 102; etc. The shaft 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 108 may be attached to, engaged with, and/or extend from the shaft 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle 108 may be integrally formed as a unitary, one-piece construction with the shaft 106. Additionally, any desired grip or handle 108 materials may be used without departing from this invention, including, for example: rubber materials, leather materials, rubber or other materials including cord or other fabric material embedded therein, polymeric materials, and the like.

Figure 1B:
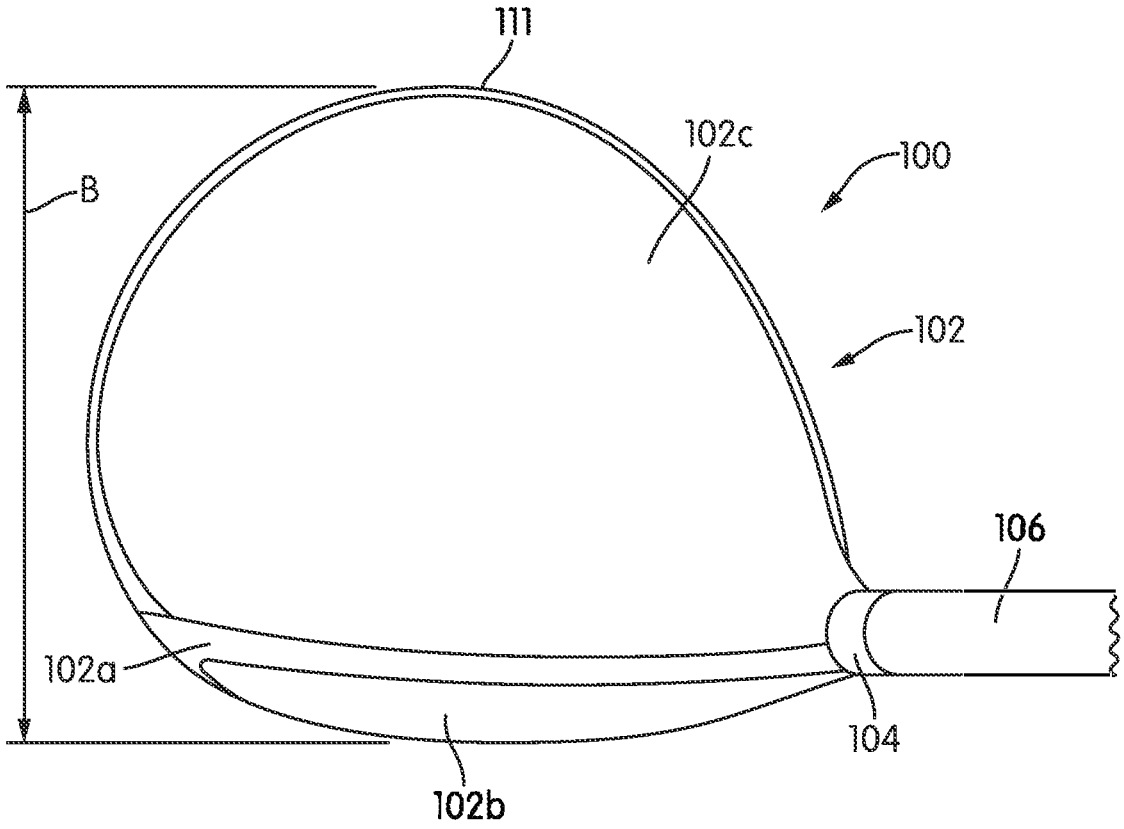

The club head 102 itself also may be constructed in any suitable or desired manner and/or from any suitable or desired materials without departing from this invention, including from conventional materials and/or in conventional manners known and used in the art. For example, in the example club head 102 shown in FIG. 1, the club head 102 includes a front face 102*a* that generally includes a ball striking surface 102*b* (optionally including a ball striking face plate integrally formed with the ball striking surface 102*a* or attached to the club head such that the face plate and a frame together constitute the overall ball striking surface 102*a*). The front face 102*a* may be considered a ball striking face 102*a*. The club head 102 may further include a top 102*c* or crown, a sole 102*d*, a toe 107 and a heel 109. The club head 102 may also include a rear 111 (FIG. 1B).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown, sole, front face, rear, etc.) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. Additionally or alternatively, the various parts of the club head may be formed of one or more composite materials. Injection molded parts are also possible. The club head 102 also may be made by forging, casting, or other desired processes, including club head forming processes as are conventionally known and used in the art. The golf club head 102 could further be formed in a single integral piece.

The various individual parts that make up a club head structure 102, if made from multiple pieces, may be engaged with one another and/or held together in any suitable or desired manner, including in conventional manners known and used in the art. For example, the various parts of the club head structure 102, such as the front face 102*a*, ball striking surface 102*b*, the top 102*c*, the sole 102*d*, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention, and the dimensions may be consistent with those commonly used in the art for similar club heads and clubs.

Several embodiments of golf club heads are disclosed herein. It is understood that the description of the club head and various components described above regarding FIGS. 1A and 1B will apply to the other embodiments described herein. It will be appreciated that the several different embodiments may utilize a geometric weighting feature. The geometric weighting feature may provide for reduced head weight and/or redistributed weight to achieve desired performance. For example, more weight may be positioned towards the rear ends of the heel and toe of the club head. In the various embodiments disclosed herein, the golf club head may have a body having spaced legs defining a void, space or gap in between the legs. The club heads herein may be considered to have a portion removed to define the void, space or gap. The body may include a cover that is positioned over the void and/or the legs, and may be an integral component of the body or separately attached. Additional support members and/or weight assemblies may also be utilized with certain embodiments.

As further shown in FIGS. 2-6, the golf club head 200 has a body 202 that includes and defines a front 210, a rear 212, a top or crown 214 (FIG. 6), a toe 216, a heel 218 and a sole 215. The front 210 generally defines a ball striking face 211. The ball striking face 211 may take various forms and in an exemplary embodiment, may utilize variable face thickness designs such as disclosed in U.S. patent application Ser. No. 13/211,961 which is incorporated by reference herein and made a part hereof. The ball striking face 211 may alternately have a constant thickness. It is further understood that the ball striking face 211 may be separately connected to the golf club head body 202 such as in a welding process. The club head 200 has a sole 215 extending from a base of the body 202 proximate the ball striking face 211 towards the rear 212 of the club head body 202. The golf club head 200 may, in some arrangements, include a geometric weighting feature. In one exemplary embodiment, the club head 200 has a void 230, gap, or space, formed generally in the rear 212 of the golf club head body 202. The void 230 may, in some examples, be substantially v-shaped and/or may extend entirely through the golf club head 200 (e.g., from the crown to the sole). The void 230 opens into the rear of the golf club head. The body 202 may form the hosel at the heel 218 of the body 202. It is understood that the various structures of the body 202 may define an internal cavity having an internal volume.

Figure 2:
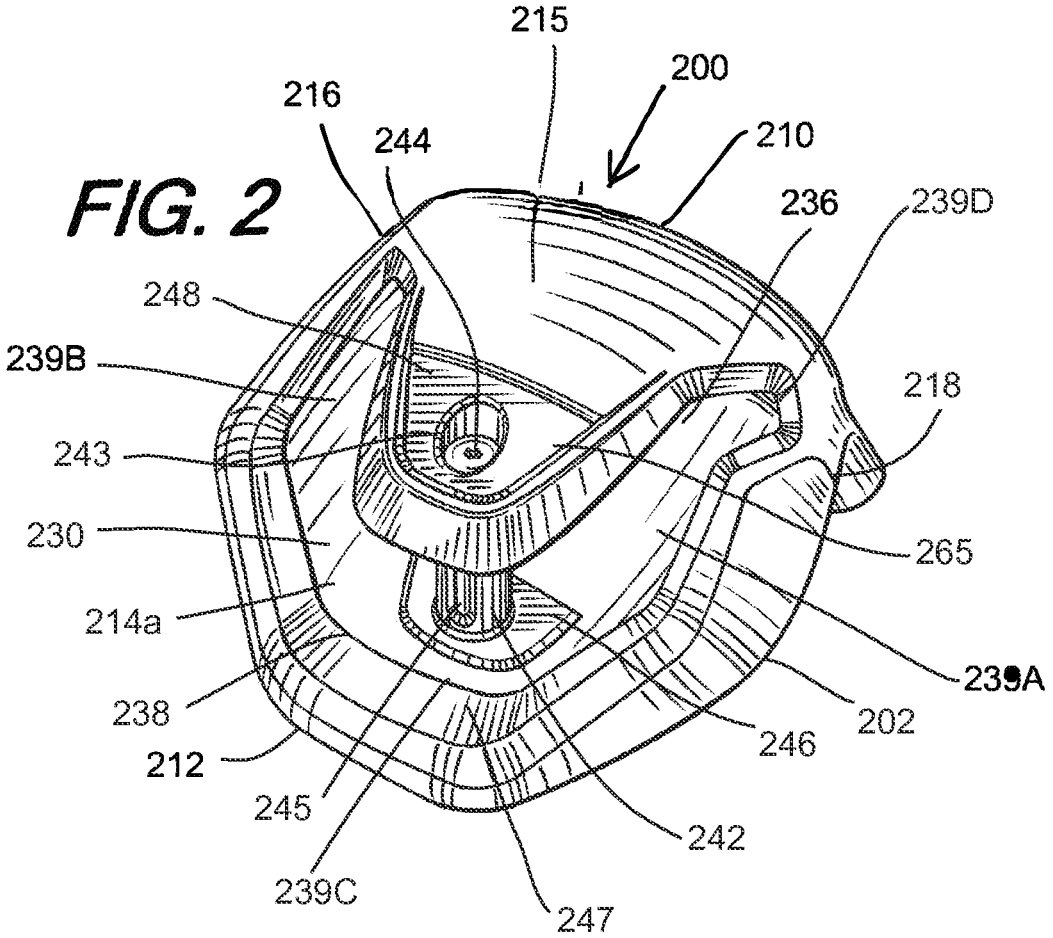
FIG. 2 is a bottom, rear perspective view of an example embodiment of a golf club head with an adjustable weight arrangement according to one or more aspects described herein.
Figure 3:
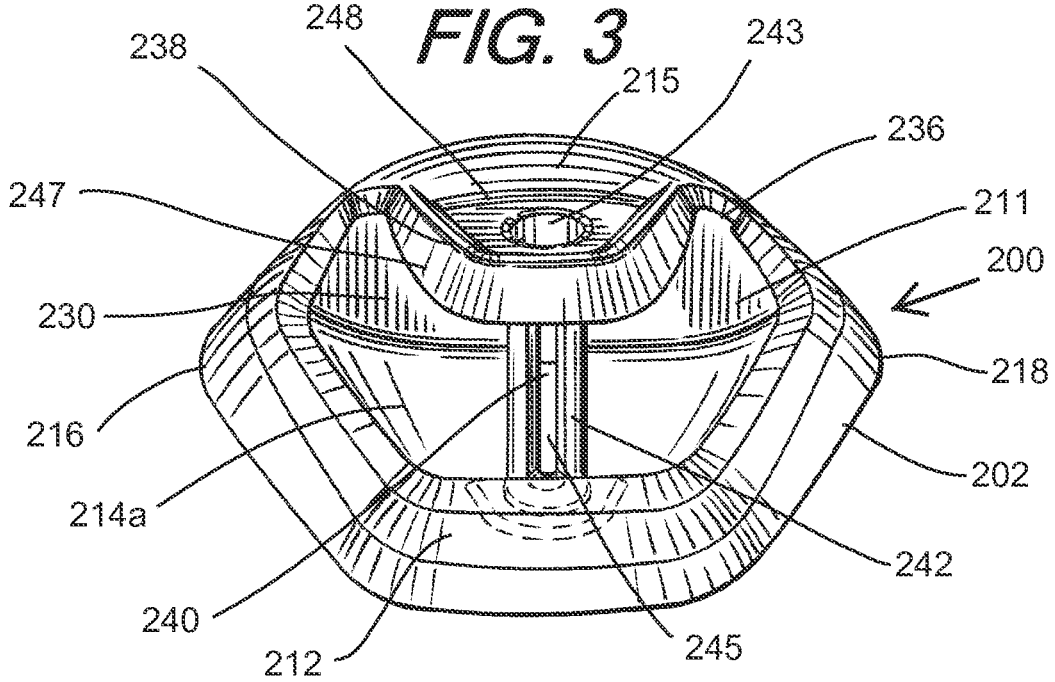
FIG. 3 is a rear view of the head of FIG. 2.
Figure 4:
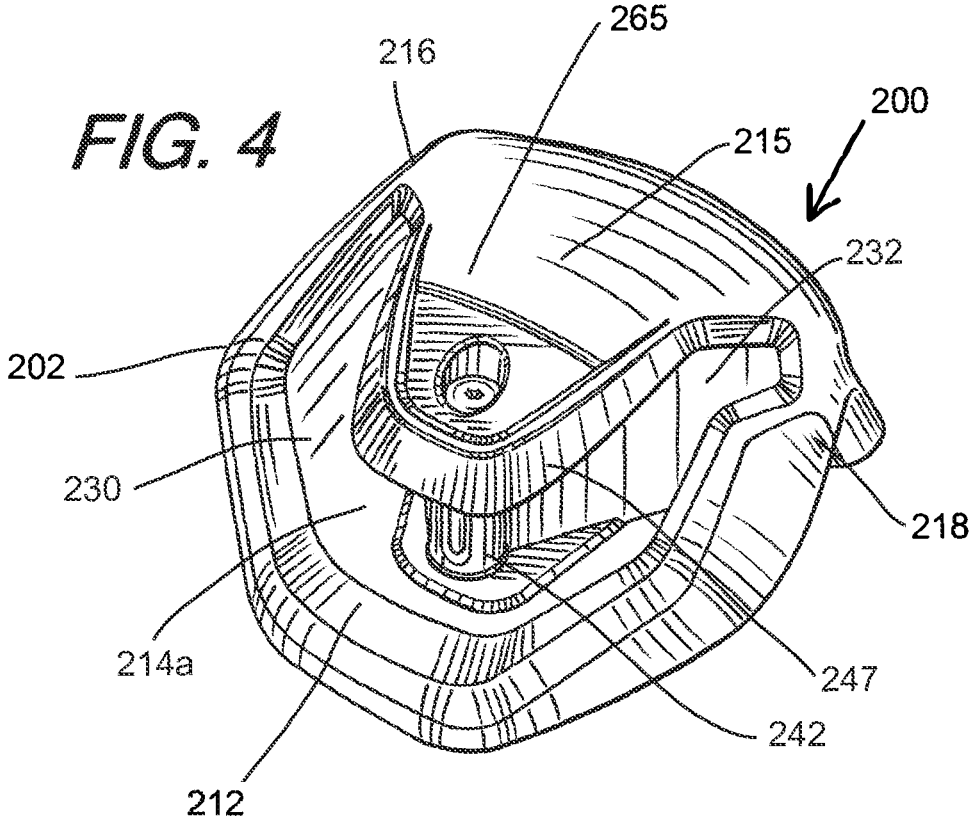
FIG. 4 is a bottom, rear perspective view of another example embodiment of a golf club head with an adjustable weight arrangement according to one or more aspects described herein.
Figure 5:
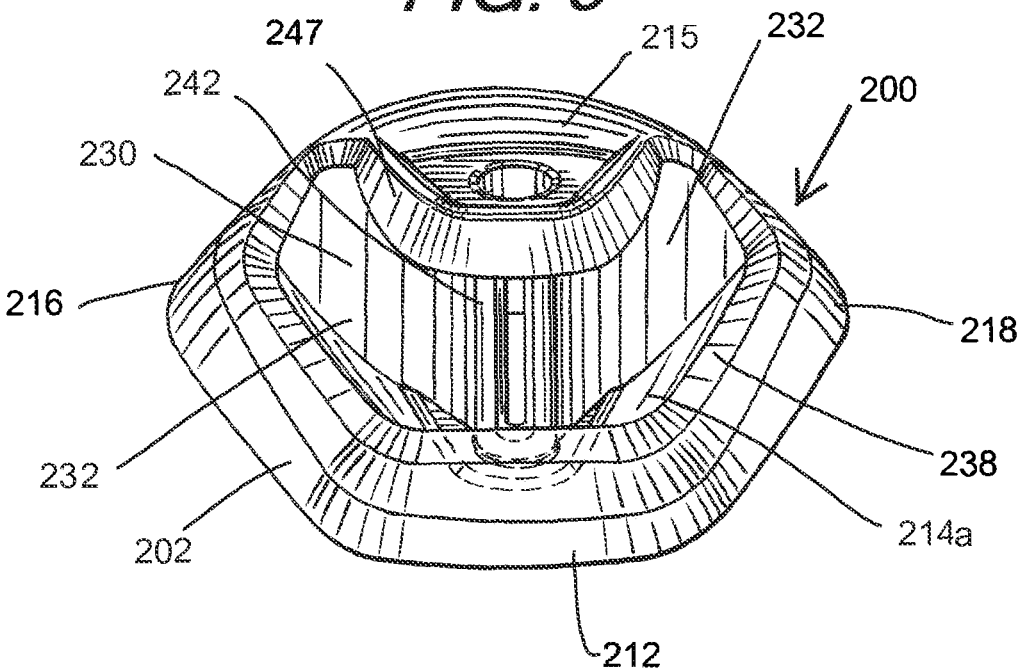
FIG. 5 is a rear view of the head of FIG. 4.

The void 230 extends inwardly from an opening 236 in the body 202, which is defined by a peripheral edge 238. In the embodiment shown in FIGS. 2-6, the void 230 may extend inwardly from the toe 216 and the heel 218 and around the rear 212 of the head 200, and may be wider proximate the rear 212 than proximate the heel 218 or toe 216. The void 230 may also extend from the sole 215 to the top or crown 214, as also shown in FIGS. 2-6. The void 230 may border at least a portion of a top side 215*a* of the sole 215 and at least a portion of an underside 214*a* of the crown 214, as shown in FIGS. 2-6. In one embodiment, as shown in FIGS. 2-3, the void 230 may extend inwardly all the way to the inner surface of the ball striking face 211. In another embodiment, as shown in FIGS. 4-5, the head 200 may have one or more walls 232 extending from the sole 215 to the crown 214 and combining with surfaces of the body 202 to define an enclosed interior cavity 234 behind the ball striking face 211. In this embodiment, the void 230 may be bounded and defined by the wall(s) 232 and does not extend to the face 211. The void 230 in this embodiment represents an open section behind the enclosed interior cavity 234. Additionally, in one embodiment, the enclosed interior cavity 234 occupies between 30-70% of the total displacement of the head 200, as determined using USGA official methods. Further embodiments of club heads may have voids that are configured differently, such as the embodiments in FIGS. 12-14, described below. The void 230 formed in the golf club head 200 may reduce the overall weight associated with the golf club head, redistribute weight of the club, and may aid in adjusting the performance characteristics of the golf club head 200.

The opening 236 to the void 230 (and the edge 238 defining the opening 236) has a generally U-shaped configuration in the embodiments of FIGS. 2-7. As seen in FIG. 2, the opening 238 has a first portion or heel portion 239A on the heel 218 of the body 202, a second portion or toe portion 239B on the toe 216 of the body 202, and a connecting portion 239C that extends across the rear 212 of the body 202 and connects the heel portion 239A and the toe portion 239B. The heel portion 239A and the toe portion 239B extend generally from the rear 212 toward the face 211, and the heel portion 239A also includes an angled portion 239D proximate the face 211 that angles toward the heel 218 with respect to the rest of the heel portion 239A. In this configuration, the U-shaped void 230 defines a peninsula 265 on the sole 215 extending rearwardly from a point proximate the face 211, where the heel portion 239A and the toe portion 239B are positioned on opposite sides of the peninsula 265. Further, in this embodiment, the opening 236 is defined on the sole 215 and is not visible from above when the club head 200 is in the address position, however in other embodiments, at least a portion of the opening 236 extends through the crown 214 of the body 202.

In some example embodiments, the golf club head 200 may be formed as a single piece that includes the body 202 with a cover 250 forming at least part of the crown 214 of the head 200. For instance, the front 210 (including the face 211), rear 212, crown 214, toe 216, heel 218 and sole 215 may be a single piece unit. In another embodiment, the face 211 may be formed of a separate structure from the body 202, such as, e.g., a face plate or cup face structure. The body 202 may be formed of a single piece or multiple pieces in this embodiment. The golf club head 200 and/or metallic components thereof may be formed using known methods of manufacture, such as casting, molding, forging, etc., and various combinations thereof. Thus, in one example, the golf club head body 202 may be cast in a metal material such as titanium. The weight receiver 242, as described below, may be formed together with one or more other components of the body 202 or may be formed separately and attached to the body 202, in various embodiments. The void 230 may be formed in the golf club head during the initial manufacturing process of the golf club head (e.g., during casting) or may be formed into the golf club head 200 using an additional process (e.g., by cutting).

As mentioned above, and as shown in FIGS. 2-6, the golf club head 200 further includes the cover 250. The cover 250 may, in some examples, cover the rear 212, or a portion of the rear 212, of the golf club head body 202, or may otherwise extend past the sole 215, such that the void 230 and the sole 215 are not visible when the golf club head 200 is in use, especially when the golf club head 200 is at an address position with the golfer standing over the golf club head 200. That is, with the cover 250 in position, the golf club head 200 may appear similar to a conventional golf club head that does not include a void 230 in the rear 212 of the golf club head 200. However, the performance advantages (e.g., reduced weight, redistributed weight, etc.) would be provided. The cover 250 may, in some examples, extend over the crown 214 of the golf club head body 202 such that the void 230 may be visible when the golf club head 200 is viewed from the sole 215, but the void 230 may be obstructed from view when viewed from the top of the club 200. Additionally or alternatively, the cover 250 may extend over the entire rear 212 of the golf club head 200 and may cover the crown 214 and sole 215 of the golf club head such that the void is not visible when the golf club head is viewed from any angle.

In the embodiments of FIGS. 2-7, the cover 250 is formed of the same material as the rest of the body 202, and may be formed of a single piece with the body 202. In another embodiment, the cover 250 may be formed separately and may be formed of a different material from the body 202. In such an embodiment, the cover 250 may be formed of any suitable material, such as lightweight metals, alloys, composite, plastic, etc. A polymer-based cover 250 may further have a nano-coating to provide a metallic-type finish or some other treatment to provide such look. A separate cover 250 may be connected to the golf club head using known methods of connection, including mechanical fasteners, snap fits, screws, adhesives, friction fits, and the like. Additionally, the covers 250 shown in FIGS. 2-6 form the crown 214 of the body 202, however in another embodiment, the cover 250 may cover at least a portion of the crown 214 of the body 202. Further, in some arrangements, the cover 250 may be removable and or interchangeable with other covers, and such other covers may have different performance characteristics. For instance, the cover may be interchanged with other covers having different weighting characteristics. Alternative covers may further have different aesthetic characteristics or may incorporate different training guides.

The head 200 may further include stiffening or strengthening structures, such as to influence one or more properties of the head 202, such as vibrational properties, acoustic properties, impact response properties, etc., and/or to increase the durability and structural stability of the head 200. In the embodiments of FIGS. 2-6, the head 200 includes a lip 247 that extends around the edge 238 defining the opening 236 of the void 230. The lip 247 extends inwardly into the void 230 and may be angled with respect to some or all of the adjoining surfaces of the body 202. In one embodiment, the lip 247 extends inwardly from the entire edge 238 defining the opening 236, as shown in FIGS. 2-6. In another embodiment, the lip 247 extends from at least a portion of the edge 238, and may be intermittently located around the edge 238, such as at areas where stress is more concentrated. The lip 247 may have a width that may be constant at all locations or may vary at different locations. The thickness of the lip 247 may also be constant or may vary in various embodiments. FIG. 11 illustrates another embodiment, where the lip 247 has a greater width in the region around the receiving tube 242 than the lip 247 of FIGS. 2-6, which adds increased strength to that region. In the embodiments of FIGS. 2-6 and 11, the peninsula 265 on the sole 215 at least partially supports a receptacle or receiver 242 for a weight 240, and the lip 247 around the peninsula 265 adds structural stability to the peninsula 265. In one embodiment, the lip 247 may extend at least around the entire peninsula 265.

In one embodiment, the head 200 has an additional stiffening or strengthening structure in the form of a wall or walls 232 that extend inwardly from the crown 214 and/or the sole 215. In the embodiment of FIGS. 4-7, two walls 232 completely separate the ball striking face 211 from the void 230 and extend from the underside 214*a* of the crown 214 to the top side 215*a* of the sole 215 and from the toe 216 and the heel 218 to the weight receiver 242. In this configuration, the walls 232 combine with surfaces of the body 202 to define an enclosed interior cavity 234 behind the ball striking face 211, as described above. The void 230 may be bounded and defined by the walls 232 and does not extend to the face 211 in this embodiment, and the walls 232 separate the void 230 from the interior cavity 234. In another embodiment, the wall(s) 232 may extend forwardly or rearwardly of the receiving tube 242, and may not be connected to the receiving tube 242. In a further embodiment, the head 200 may include walls 232 that do not completely separate the face 211 from the void 230, such as by not extending all the way from the crown 214 to the sole 215, not extending all the way across the body 202 laterally (e.g., heel 218 to toe 216), and/or having openings or passages therein.

The golf club head 200 may utilize a weight assembly to further enhance performance of the club head 200. In an exemplary embodiment, the head 200 includes a receptacle or receiver 242, which may be in the form of a receiving tube 242, as in the embodiments of FIGS. 2-7. The receiving tube 242 may be integrally formed with one or more portions of the golf club head 200 or may be formed as a separate portion and connected to the golf club head 200 using known methods of connection, such as adhesives, mechanical fasteners, snap fits, welding, and the like. Further, in one embodiment, at least a portion of the exterior surface of the receptacle (receiving tube 242) is exposed to the void 230. In the embodiment of FIGS. 2-3, the entire exterior surface of the receiving tube 242 is exposed to the void 230, and in the embodiment of FIGS. 4-5, a portion of the exterior surface of the receiving tube 242 is exposed to the void 230, and another portion is exposed to the interior cavity 234. A weight 240 of the weight assembly is configured to be received by the receiving tube 242, and the receiving tube 242 has an opening 243 in the sole 215 for insertion of the weight 240. In another embodiment, the opening 243 may be additionally or alternately located in the crown 214 of the head 200. FIGS. 2-5 show the weight 240 in the tube 242, and FIG. 6 shows the weight 240 in an exploded configuration, in position to be inserted into the tube 242.

Figure 6:
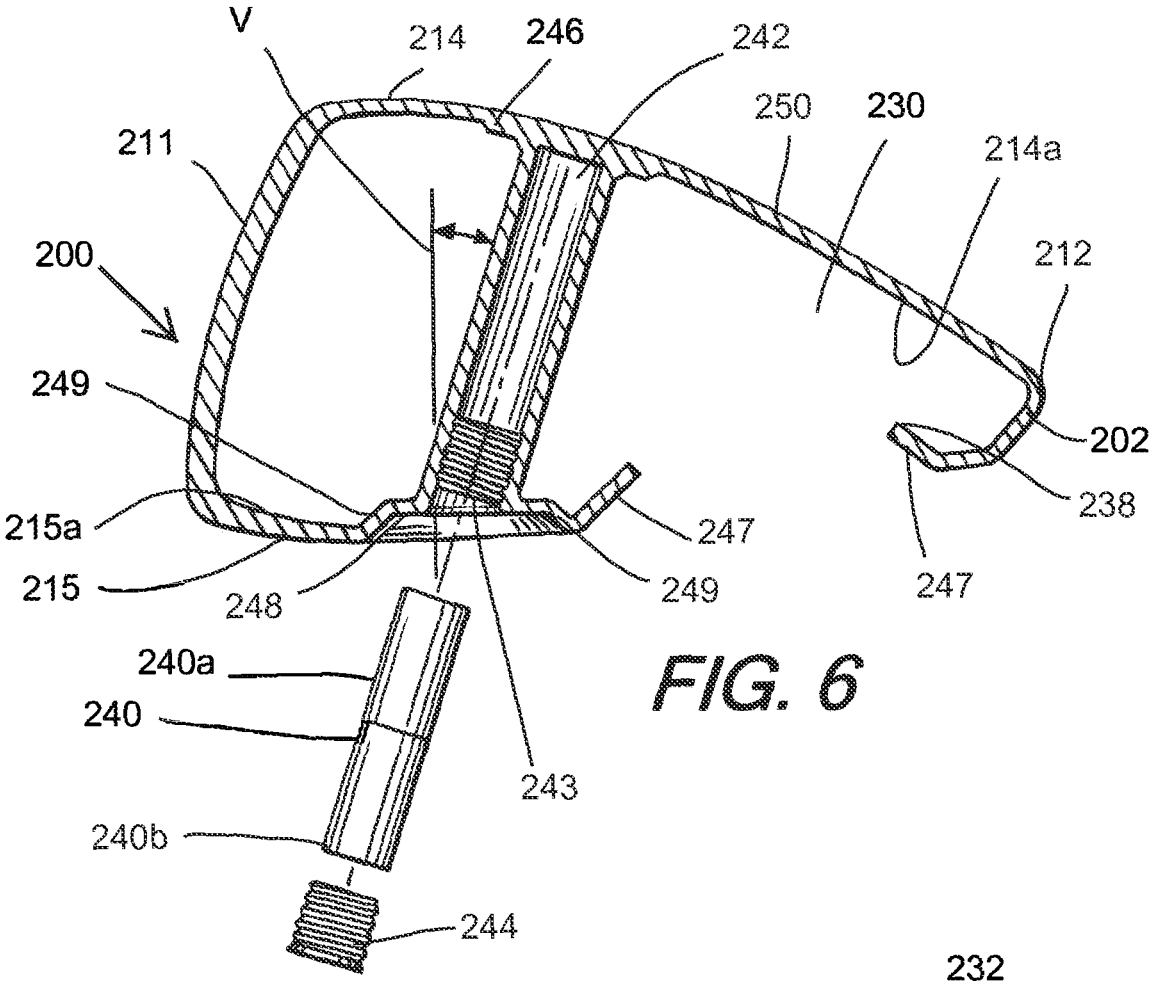
FIG. 6 is a cross-sectional view of the head of FIGS. 4-5, taken along line 6-6 in FIG. 5, illustrating the insertion of a weight into a receiver in the head.

In the embodiments illustrated in FIGS. 2-7, the receiving tube 242 generally has a height that extends from an underside 214*a* of the crown 214 and/or the cover 250 to the bottom or sole surface 215*b* of the sole 215 of the club head body 202. In this configuration, the crown 214 and/or the cover 250 combines with the sole 215 to support the receiving tube 242. As illustrated in FIGS. 2, 4, and 6, the underside 214*a* of the crown 214/cover 250 in one embodiment has a platform 246 that is connected to the top end of the receiving tube 242, in order to provide a stronger and more stable mounting surface. The platform 246 as illustrated in FIGS. 2-7 is formed by a thickened portion of the cover 250 and is integral with the cover 250. In another embodiment, the platform 246 may have a different structure and/or may be formed separately and connected to the underside 214*a* of the crown 214 of the body 202. Additionally, as illustrated in FIGS. 2-6, the sole 215 has a recessed area 248 defined by sloping walls 249 located around the tube opening 243. In the embodiment as shown in FIGS. 2-6, the recessed area 248 is formed within the peninsula 265 on the sole 215. The receiving tube 242 is mounted to the top side 215*a* of the sole 215 at the recessed area 248, and the sloping walls 249 provide increased stiffness and strength to the area surrounding the mounting. The recessed area 248 also spaces the tube opening 243 from the playing surface during use. The receiving tube 242 may have varying heights as desired and may alternately be mounted to have one or both ends spaced away from the inner surfaces of the crown 214 or sole 215 in other configurations. A closure 244 can also be provided to secure the weight 240 in the receiving tube 242. In the embodiment of FIGS. 2-6, the closure 244 is in the form of a threaded fastener 244 that mates with internal threads in the receiving tube 242 to secure the weight 240 in the receiving tube 242.

The receiving tube 242 and weight 240 may have corresponding shapes such that the weight 240 may slide into the receiving tube 242. In some examples, the weight 240 and receiving tube 242 may be cylindrical, square, rectangular, etc. The receiving tube 242 may have a longitudinal axis and the weight may have a longitudinal axis, and the longitudinal axes may generally correspond when the weight 240 is received in the tube 242. In the embodiment shown in FIG. 6, the longitudinal axis of the tube 242 is generally vertical and generally parallel to the ball striking face 211, with the understanding that the ball striking face 211 may have a certain amount of loft. In the example shown in FIGS. 2-6, the receiving tube 242 is generally vertical in arrangement (e.g., in a vertical position when the golf club head is in an at address position). However, various other tube arrangements, positions, etc. may be used without departing from the invention. Some other arrangements, positions, etc. will be described more fully below.

The receiving tube 242 may receive the weight 240, which may be a single weighted member or may have portions with different weighting characteristics or weight values, which can allow for differing weighting characteristics and arrangements to alter the performance characteristics of the club head 200. For instance, the weight 240 may have one end 240*a* that is heavier than an opposite end 240*b* wherein the weight 240 can be flipped as desired. Such differing weights may be achieved by use of different materials and/or by using weight-doping materials (e.g. tungsten) in different concentrations. Additionally, a weight 240 that is differentially-weighted may be a combination of smaller weights that may be permanently or releasably connected together. In some arrangements, the heavier end 240*a* may be positioned towards the crown 214 of the golf club head 200 to provide a first weight arrangement with a relatively higher center of gravity (CG) or alternatively, towards the sole 215 of the golf club head 200 to provide a second weight arrangement with a relatively lower CG. The different weight arrangements can affect performance of the club head 200. The weight 240 may have more than two differently-weighted portions in another embodiment. In further embodiments, different and/or additional structures can be operably associated with the head 200 to removably support weight members thereon. In the various embodiments described herein, the weight members 240 may be made of a material heavier than the remainder of the golf club head 200 or portions of the head. In other exemplary embodiments, the weight member(s) 240 may be made of the same material as the remainder of the golf club head 200 or portions thereof. In certain exemplary embodiments, the weight member may be formed from steel, aluminum, titanium, magnesium, tungsten, graphite, polymers, or composite materials, as well as alloys and/or combinations thereof.

Additionally or alternatively, the weight member 240 may include multiple weights or portions of the weight 240 that can be received within the weight receptacle 242 in different arrangements to achieve different weighting characteristics; e.g. three pieces with one piece being heaviest. Such multiple weights can be releasably fastened to one another in one embodiment. The different weights may also have different weight values. In some examples, the heaviest member can be at either end or at a middle of the member. Various other combinations of weight members may be used without departing from the invention. The overall height of the weight member 240 along with the length of the threaded fastener 244 may generally correspond to the height of the receiving tube 242 so that the weight 240 fits snugly in the tube 242 and does not slide within the tube during use. It is understood that the threading in the receiving tube 242 may be configured such that the fastener 244 may be threaded different distances into the receiving tube 242 to engage and secure weights 240 having different lengths within the receiving tube 242. Additionally, the tube 242 and/or the weight 240 may have shock absorbing features if desired, and that plugs or fillers may be inserted into the receiving tube 242 to ensure a snug fit for a weight 240 that has a shorter length than the receiving tube.

The position of the weight 240 and receiving tube 242 proximate the geometric center of the club head 200 may aid in adjusting the center of gravity near a central region of the golf club head 200. Weight in the tube 242 can be focused in the tube 242 to provide a low center of gravity or a high center of gravity. The weight 240 can also be configured to provide a more neutral center of gravity. The insertion or removal of weight 240 may add or remove additional weight from the overall weight of the golf club head 200 and may add or remove weight from the central region, thereby adjusting the performance characteristics of the golf club head 200. Thus, different interchangeable weights 240 can be selected to increase or decrease the overall weight of the club head 200. Such weighting characteristics provided by the weight 240 in the tube 242 can further impact golf ball trajectory by providing a change in ball spin. It has been determined that this weighting feature can provide a change of approximately 500-600 rpm in ball spin. Utilizing the adjustable weight 240 in the tube 242 to affect ball spin as well as considering launch angle and ball speed, a golfer can customize the golf club to achieve desired ball trajectory, distance and other characteristics. The adjustable weighting feature can further be used to customize the club head 200 to produce a desired ball spin for a particular golf ball being used.

As further shown in FIGS. 2-5, the receiving tube 242 may have a window 245 to allow one to see the weight 240 in the tube 242. The weight(s) 240 may be provided with indicia to the allow for easy determination of the particular weighting arrangement provided by viewing through the window 245.

Figure 12:
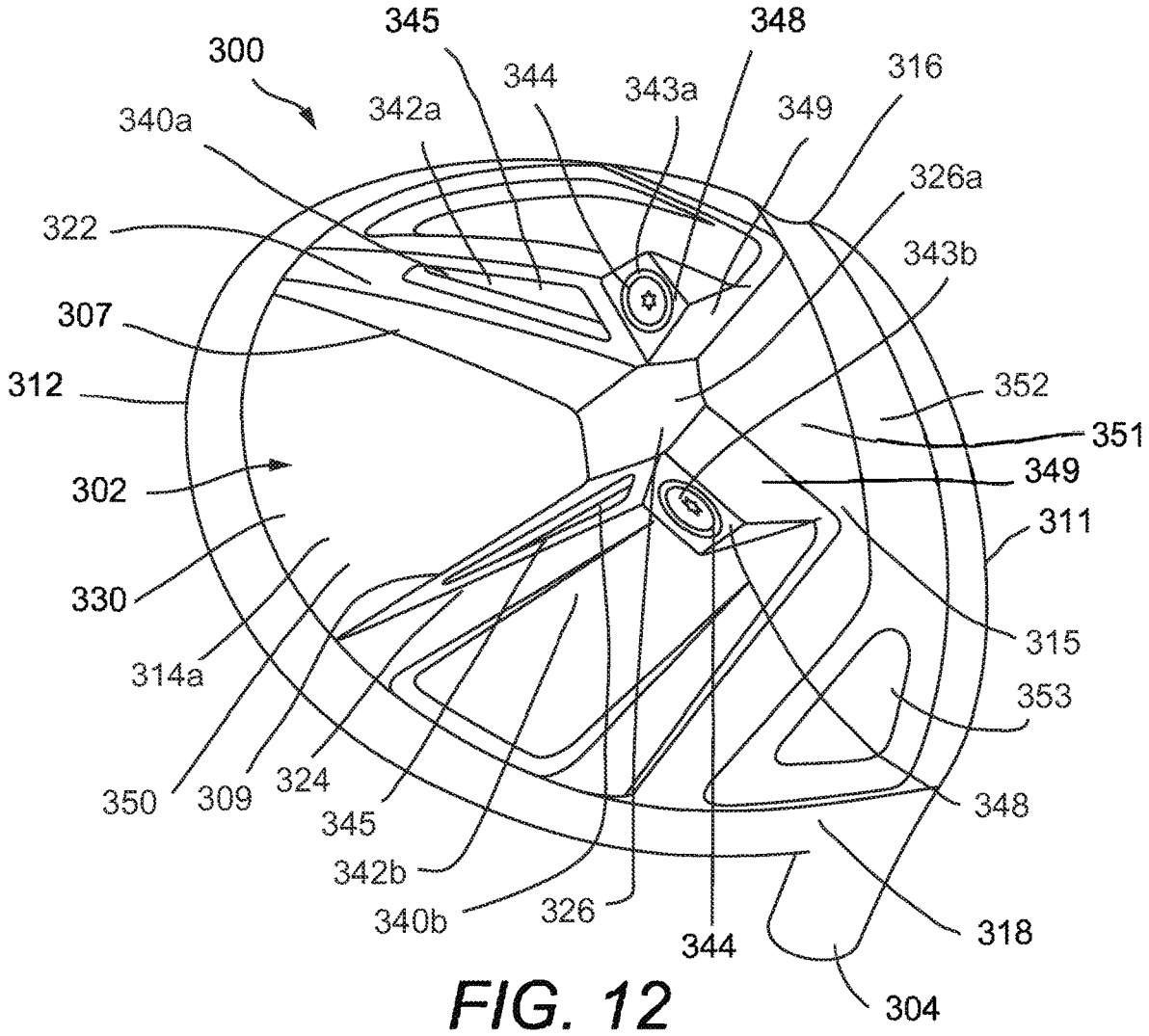
FIG. 12 is a bottom, rear perspective view of another example embodiment of a golf club head with an adjustable weight arrangement according to one or more aspects described herein.
Figure 13:
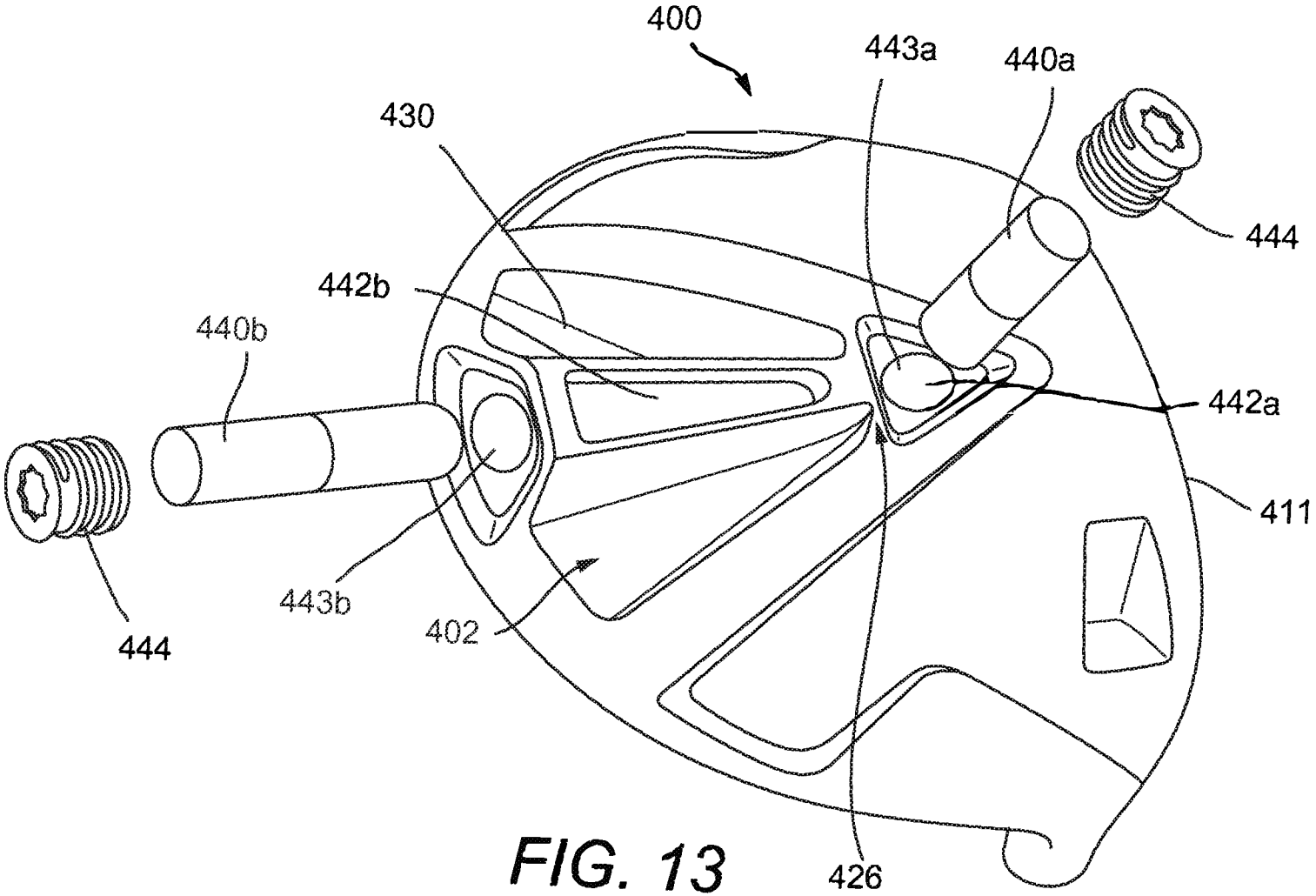
FIGS. 13 and 14 are bottom, rear perspective views of another example embodiment of a golf club head with an adjustable weight arrangement according to one or more aspects described herein, with FIG. 13 illustrating the insertion of two weights into two receivers in the head.
Figure 14:
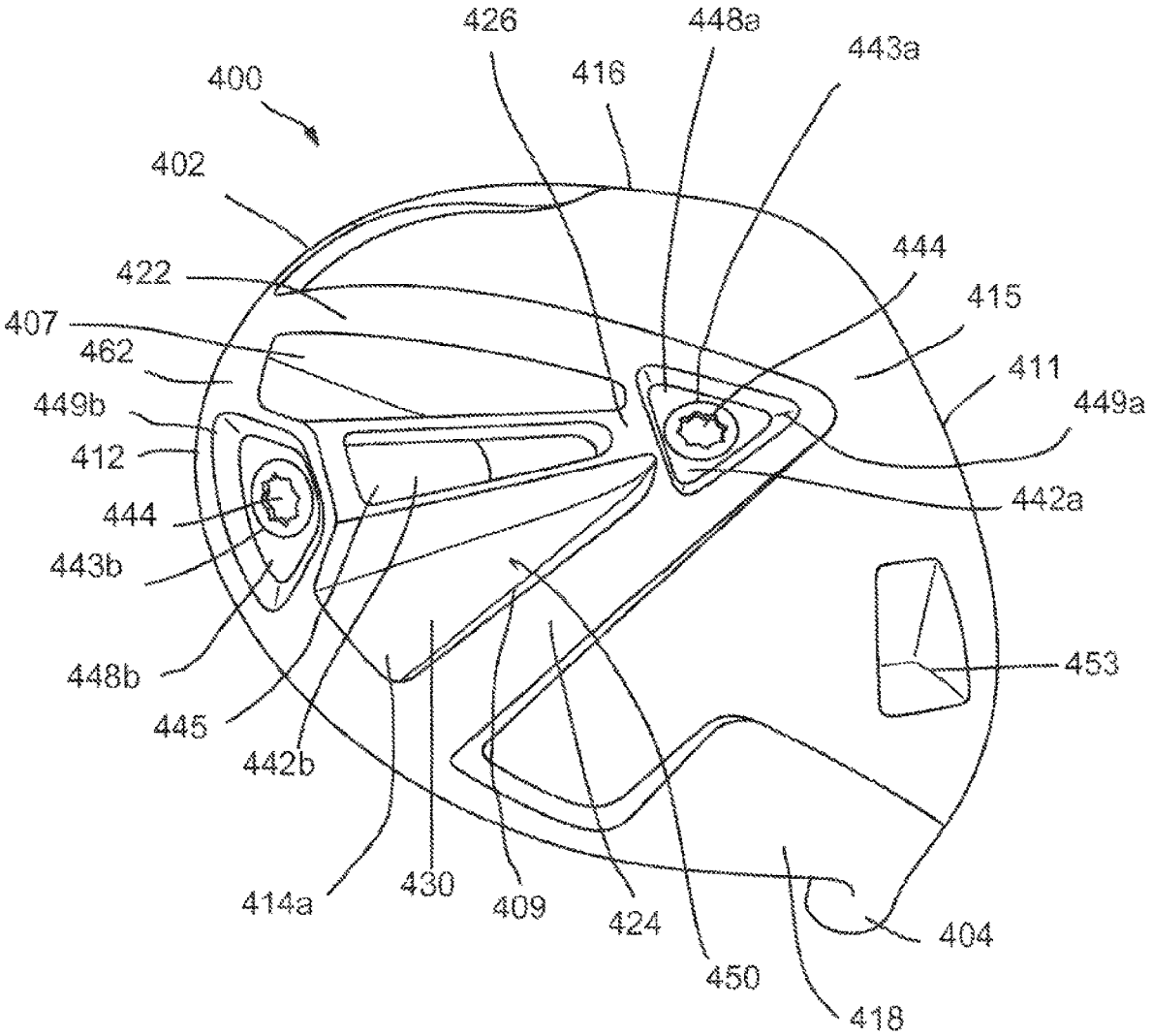

As illustrated in FIGS. 2-3, the entire exterior of the receiving tube 242 may be exposed in one embodiment, such that the void 230 completely surrounds the receiving tube 242. In another embodiment, as shown in FIGS. 4-5, the receiving tube 242 may be partially enclosed within a rear portion of the golf club head 200, such that a portion of the receiving tube 242 may be exposed to the void 230. The void 230 may provide ease of access to the weight 240 and/or the fastener 244 for adjustment, in these embodiments. In a further embodiment, the receiving tube 242 may be completely enclosed within the head 200, without departing from the invention. FIGS. 12-14 (discussed below) illustrate receiving tubes 242 that are completely enclosed within the head 200.

In some arrangements, the receiving tube 242 may be angled with respect to the face 211, the sole 215, and/or the vertical axis of the club head 200 when in a playing position.

As described herein, the "vertical axis" extends along a line perpendicular to a flat playing surface when the club head 200 is in a playing position, with the axis of the hosel 104 in a vertical plane and with the face 211 set to the desired loft angle specified for the club head 200. Thus, the weight member may be adjusted in a hybrid fashion, e.g., both high/low and fore/aft, by adjusting the weight 240 within such an angled receiving tube 242. In one embodiment, the axis of the receiving tube 242 may be between 0-60° from the vertical axis. In other embodiments, the axis of the receiving tube 242 may be between 0-50° or 20-50° from the vertical axis. In the embodiment illustrated in FIGS. 2-6, the axis of the receiving tube 242 is generally parallel to the face 211 and is slightly angled (e.g., 15°) the rear 212 with respect to the vertical axis V from the sole 215 toward the crown 214. Thus, the weight 240 in FIG. 6 can be flipped to adjust the CG upward and rearward with respect to the vertical axis or forward and downward with respect to the vertical axis. It is understood that the receiving tube 242 illustrated in FIG. 6 is in a vertical plane (as defined by the vertical axis) with respect to the heel-toe direction, and the same is true of the tubes 242 in FIGS. 8-10 described below. In another embodiment, the receiving tube 242 may additionally or alternately be angled with respect to the vertical axis in the heel-toe direction.

Figure 8:
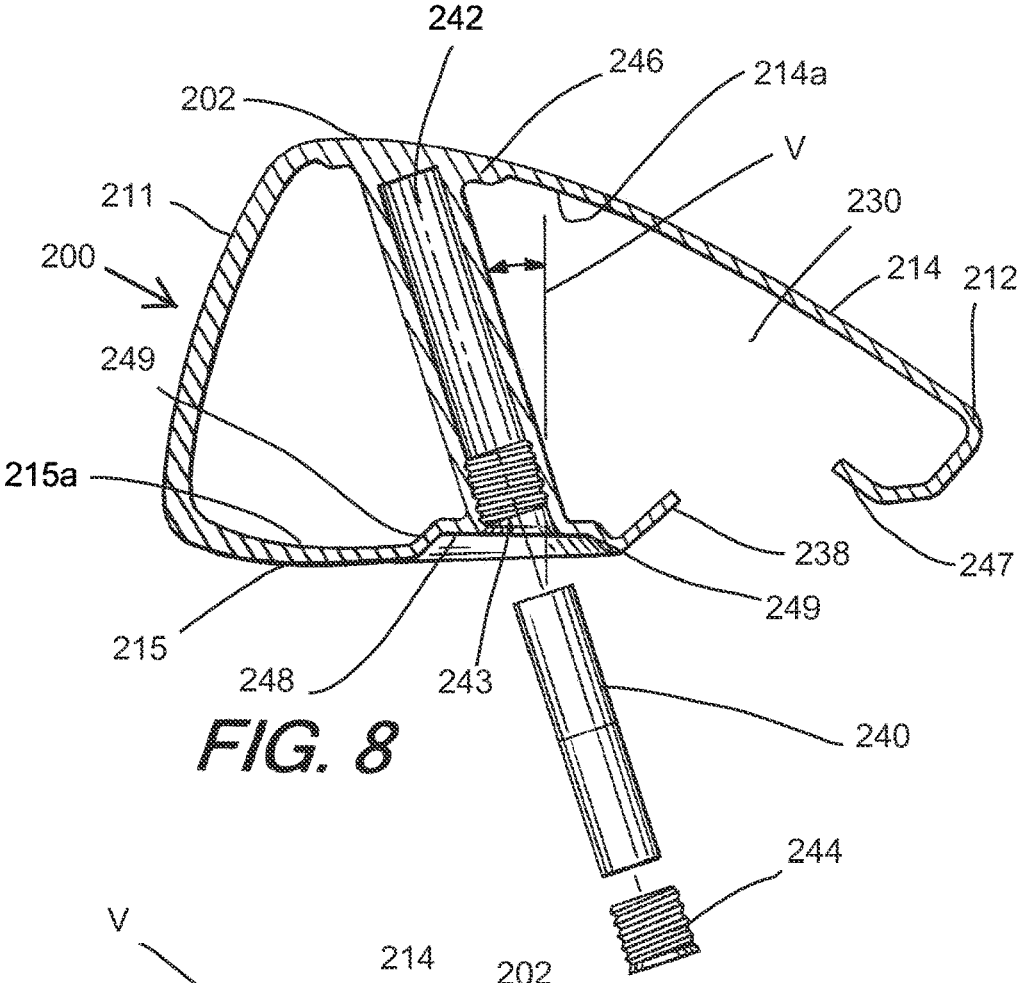
FIG. 8 is a cross-sectional view of another example embodiment of a golf club head with an adjustable weight arrangement according to one or more aspects described herein, illustrating the insertion of a weight into a receiver in the head.
Figure 9:
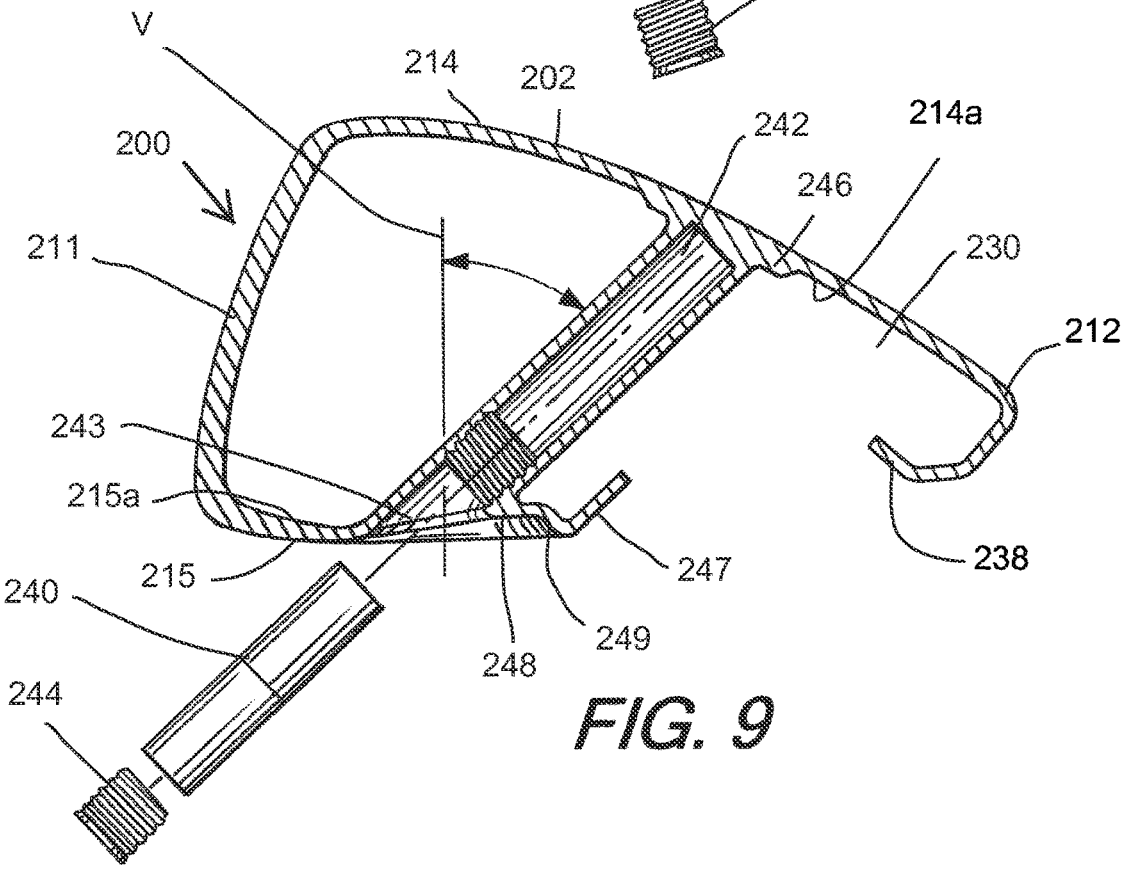
FIG. 9 is a cross-sectional view of another example embodiment of a golf club head with an adjustable weight arrangement according to one or more aspects described herein, illustrating the insertion of a weight into a receiver in the head.
Figure 9A:
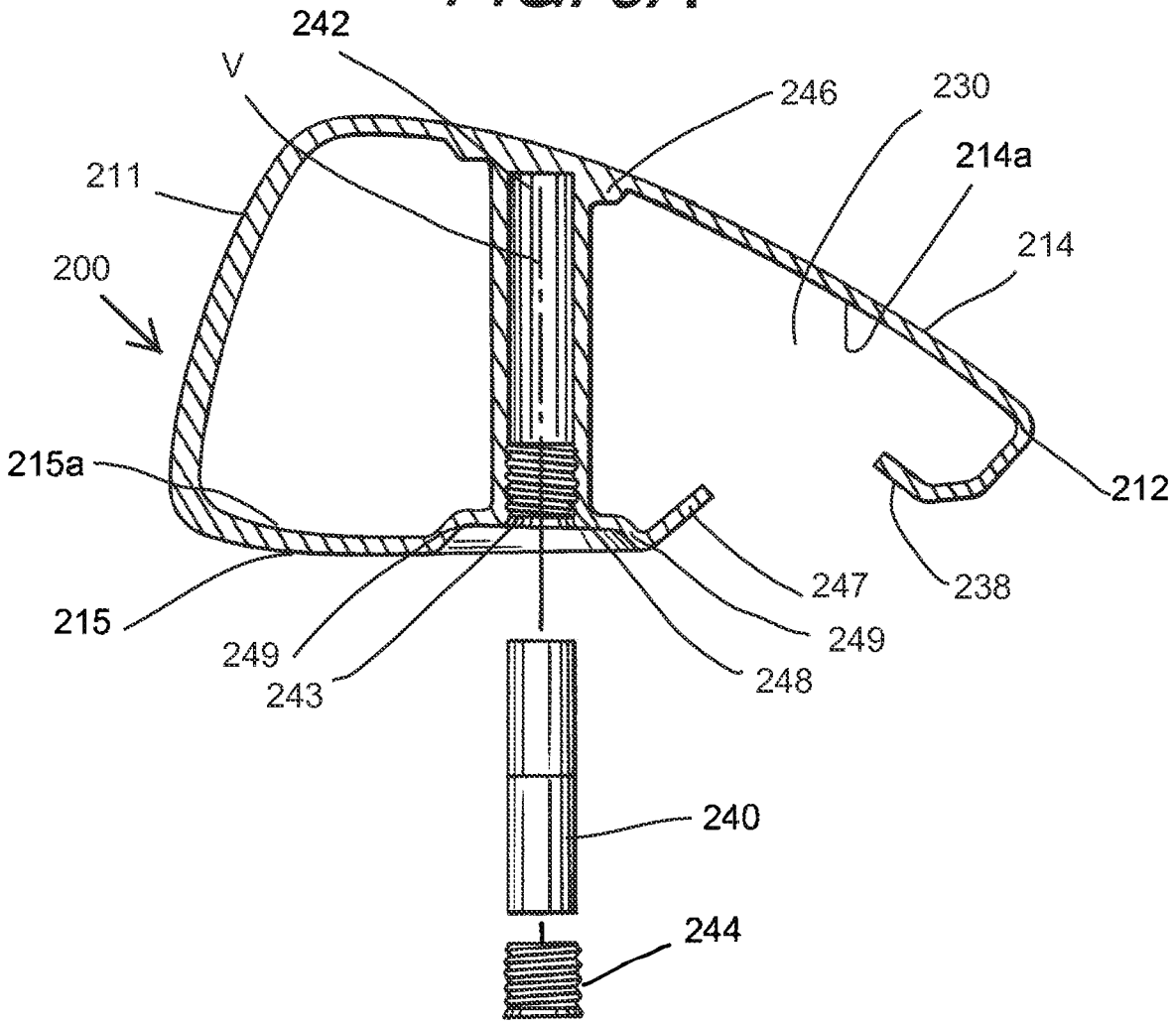
FIG. 9A is a cross-sectional view of another example embodiment of a golf club head with an adjustable weight arrangement according to one or more aspects described herein, illustrating the insertion of a weight into a receiver in the head.

Other embodiments described herein illustrate different orientations of the receiving tube 242 with respect to the vertical axis. In another embodiment, illustrated in FIG. 8, the axis of the receiving tube 242 is angled with respect to the face 211, so that the receiving tube 242 is closer to the face 211 proximate the crown 214 than proximate the sole 215, and is also angled (e.g., 15°) toward the face 211 with respect to the vertical axis V from the sole 215 toward the crown 214. Thus, the weight 240 in FIG. 8 can be flipped to adjust the CG upward and forward or downward and rearward. In another embodiment, illustrated in FIG. 9, the axis of the receiving tube 242 is angled with respect to the face 211, so that the receiving tube 242 is closer to the face 211 proximate the sole 215 than proximate the crown 214, and is also angled (e.g., 45°) away from the face 211 with respect to the vertical axis V from the sole 215 toward the crown 214. Thus, the weight 240 in FIG. 9 can be flipped to adjust the CG upward and rearward or forward and downward. In another embodiment, illustrated in FIG. 9A, the axis of the receiving tube 242 is slightly angled with respect to the face 211, so that the receiving tube 242 is closer to the face 211 proximate the crown 214 than proximate the sole 215, and is parallel or substantially parallel to the vertical axis V. Thus, the weight 240 in FIG. 6 can be flipped to adjust the CG upward or downward. The embodiments in FIGS. 8-9A are otherwise similar to the embodiment of FIGS. 2-6 as described above. Multiple receiving tubes 242 can also be utilized in vertical, horizontal or angular configurations. For example, FIGS. 10 and 12-14, which are described in greater detail below, illustrate embodiments with two receiving tubes.

Figure 7:
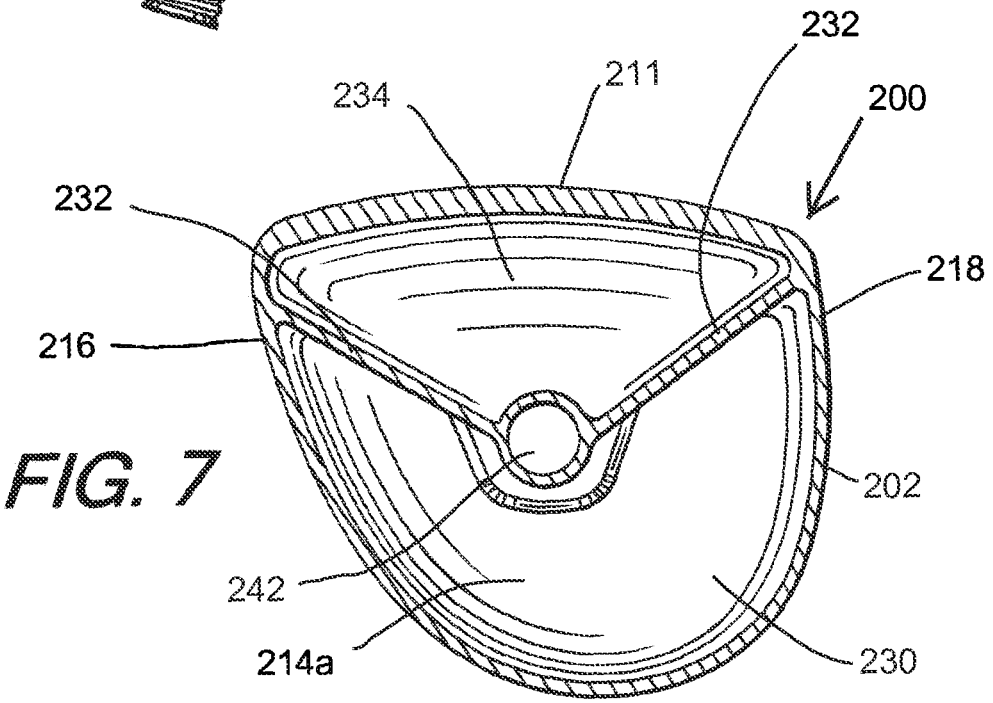
FIG. 7 is a cross-sectional view of the head of FIGS. 4-5, taken along line 7-7 in FIG. 5.

FIG. 10 illustrates another embodiment, having two receiving tubes 242A and 242B that extend from the sole 215 to the crown 214 of the head 200, similar to the receiving tubes 242 described above and shown in FIGS. 2-9A. In the embodiment of FIG. 10, the two tubes have openings 243A and 243B that are adjacent to each other, and both open into the same recessed area 248 on the sole 215. Additionally, each of the receiving tubes 242A, 242B has a separate platform 246A and 246B located on the underside 214*a* of the crown 214, to support the respective receiving tubes 242A, 242B. In this embodiment, the axis of the first receiving tube 242A is angled with respect to the face 211, so that the receiving tube 242A is closer to the face 211 proximate the crown 214 than proximate the sole 215, and is also angled (e.g., 15°) toward the face 211 with respect to the vertical axis V from the sole 215 toward the crown 214. Thus, the weight 240A in the first receiving tube 242A can be flipped to adjust the CG upward and forward or downward and rearward. In this embodiment, the axis of the second receiving tube 242B is generally parallel to the face 211, and is also angled (e.g., 15°) away from the face 211 with respect to the vertical axis V from the sole 215 toward the crown 214. Thus, the weight 240 in FIG. 9 can be flipped to adjust the CG upward and rearward or forward and downward. The second receiving tube 242B may have at least a portion exposed to the void 230 in one embodiment, or may be completely contained within the interior cavity 234 in another embodiment where the head 200 includes walls 232 as shown in FIG. 7. In other embodiments, multiple receiving tubes 242 may be provided in different configurations or orientations. As one example, multiple receiving tubes 242 may share the same opening and may be closed by a single fastener 244, rather than multiple fasteners 244 as shown in FIG. 10. As another example, more than two receiving tubes 242 may be utilized.

FIG. 12 illustrates another golf club head 300 having a void 340 formed in the rear and having adjustable weight members. The golf club head body 302 further has a base 320 and a first leg 322 and a second leg 324. The first leg 322 extends away from the front 310 and the ball striking face 311, and the second leg 324 extends away from the ball striking face 311. The legs 322, 324 also extend further away from each other from the front 310 toward the rear 312, creating a substantially v-shaped void 330 defined between the first leg 322 and the second leg 324. As shown in FIG. 12, the void 330 may extend from a rear edge 312*a* of the golf club head 300, inward, toward a center or central region of the golf club head 300 and towards the ball striking face 311. The void 330 may be wider proximal the rear edge 312*a* of the golf club head than proximal the center of the golf club head 300, thereby forming the v-shape. In one embodiment, the first leg 322 defines a first side 307 and the second leg defines a second side 309, with the sides 307, 309 being generally in confronting relation. The sides 307, 309 of the v-shaped void 330 may be generally linear or planar, or in other words, the sides 307, 309 may provide a generally flat surface. It is understood that the sides 307, 309 may further be non-linear and/or non-planar, and may define interrupted surfaces, non-flat surfaces, etc. The void 330 in the embodiment of FIG. 12 extends to the underside 314*a* of the crown 314 of the club head body 302, and the sides 307, 309 both depend from the underside 314*a* of the crown 314 of the body 302. In this embodiment, the cover 350 is formed as a single piece with the rest of the body 302, however in another embodiment, the cover 350 may be formed of a separate piece that may be connected to the body 302 by a variety of different techniques, as described above.

As further shown in FIG. 12, the legs 322, 324 and the sides 307, 309 converge towards the ball striking face 311 to an interface area 326 located between the legs 322, 324 and between the sides 307, 309. The interface area 326 may be positioned in or proximate the central region of the club head 300 and this position may vary. For example, the club head 300 defines a breadth dimension (front to rear) and the interface area 326 may be positioned at a range of 30%-60% of the breadth dimension, measured from the face 311. As another example, the interface area 326 may be positioned rearward approximately 44% of the breadth dimension, measured from the face 311. As a further example, the interface area 326 may be positioned approximately 1.875 inches rearwardly from the face 326. The sides 307, 309 and interface area 326 may have certain performance and strength enhancing structures associated therewith on internal surfaces in the internal cavity defined by the club head body 302, such as gussets or other bracing or stiffening members. The outer surfaces of the sides 307, 309 also provide strength and/or stiffness.

The golf club head 300 includes two weight members 340*a* and 340*b* that are received in two weight receivers 342*a*, 342*b*. In the embodiment illustrated in FIG. 12, one weight receiver 342*a* is located more proximate the toe 316, and the other weight receiver 342*b* is located more proximate the heel 318. The two weight members 340*a*, 340*b* may be configured similar to the weights of FIGS. 2-10, such that one end may be heavier than another end. In other embodiments, the weight members 340*a*, 340*b* and the weight receivers 342*a*, 342*b* may be arranged in another manner, such as additionally or alternately having a receiving tube similar to the arrangements described above.

The weights 340*a,b* may be similar to the weights shown in FIGS. 6 and 8-10, having ends or portions that are weighted differently, and may likewise be removed and flipped, rotated, etc., independently of each other, in order to adjust the overall weight arrangement of the golf club head 300 and to adjust the performance characteristics of the golf club head 300. The embodiment of FIG. 12 may also include weight receivers 342*a*, 342*b* that may be in the form of weight receiving tubes as described above with respect to FIGS. 2-10. In the embodiment of FIG. 12, the weight receiver 342*a* proximate the toe 316 extends along the first leg 322 and the first side 307, in a direction that angles away from the centerline of the head 300 and more toward the toe 316, as the receiver 342*a* progresses from the front 310 toward the rear 312 of the head 300. Thus, the first weight 340*a* can be adjusted to adjust the CG closer to the front 310 and the center of the head 300, or closer to the rear 312 and the toe 316 of the head 300, by flipping the weight 340*a*. Additionally, in this embodiment, the weight receiver 342*b* proximate the heel 318 extends along the second leg 324 and the second side 309, in a direction that angles away from the centerline of the head 300 and more toward the heel 318, as the receiver 342*a* progresses from the front 310 toward the rear 312 of the head 300. Thus, the second weight 340*b* can be adjusted to adjust the CG closer to the front 310 and the center of the head 300, or closer to the rear 312 and the heel 318 of the head 300, by flipping the weight 340*b*. Each weight may be adjusted independently of the other in order to customize the performance characteristics of the golf club head 300. Fasteners 344 as described above may be utilized to retain the weights 340*a*, 340*b* within the receivers 342*a*, 342*b*. The head 300 may further include windows 345 located on the sides 307, 309 and/or the legs 322, 324, which provide visibility to the insides of the weight receivers 342*a*, 342*b*.

As further shown in FIG. 12, the club head 300 may have additional structure on the sole 315. For example, the club head 300 may have a channel 352 extending across the sole of the club head 352 from the heel 318 to the toe 316 and generally adjacent the ball striking face 311. The channel 352 allows a certain amount of compression of the club head 300 upon ball impact. This feature may cooperate with the other club head structures and weighting characteristics to further enhance performance of the club. Further, a bore or access opening 353 for access to internal connecting structure of the hosel 304 for connection of the shaft (not shown in FIG. 12) is exposed within the channel 352, intersects the channel 352, and is in communication with the channel 352 in the embodiment shown in FIG. 12. The internal connecting structure may be configured for releasable and/or adjustable connection of the shaft 106, such as the adjustable connecting structures shown and described in U.S. Ser. Nos. 61/577,660 and 61/526,325, which applications are incorporated by reference herein. Other adjustable mechanisms could also be used. As another example, the club head 300 may have a flattened keel 351 on the sole 315, extending rearwardly from the channel 352 to the interface area 326. As a further example, the legs 322, 324 may each have a recessed area 348 positioned adjacent the interface area 326, where the opening 343 of each weight receiver 342*a*, 342*b* is positioned within the recessed area 348. The interface area 326 may include a sloping planar central surface 326*a* located between the two legs and extending from the sole 315 to the underside 314*a* of the crown 314, as well as two sloping planar side surfaces 349 located on opposed sides of the central surface 326*a* at obtuse angles to the central surface 326*a*. The side surfaces 349 extend inwardly from the keel 351 to the recessed areas 348. Each recessed area 348 may also be a generally planar surface in this embodiment.

FIGS. 13 and 14 illustrate another golf club head arrangement having adjustable weights. The club head 400 has a pair of spaced legs 422, 424 defining a void 430 underneath the cover 450 or crown 414 of the club head 400, as similarly described above with respect to the embodiment of FIG. 12. The legs 422, 424 also extend further away from each other from the front 410 toward the rear 412, defining the void 430 in a substantially v-shaped configuration, as described above. The legs 422, 424 define legs 407, 409 depending from the underside 414*a* of the crown 414 of the club head 400, as further described above. Still further, in this embodiment, the legs 422, 424 and the sides 407, 409 converge towards the ball striking face 411 to an interface area 426 located between the legs 422, 424 and between the sides 407, 409. The interface area 426 may be positioned in or proximate the central region of the club head 400 and this position may vary as described above with respect to FIG. 12. The sides 407, 409 and interface area 426 may also have certain performance and strength enhancing structures associated therewith, as described above. Further, the body 402 may have a bore or access opening 453 for access to internal connecting structure of the hosel 404 for connection of the shaft (not shown), as described above. The access opening 453 is exposed on the sole 415, as shown in FIGS. 13-14.

The weight arrangement shown includes two adjustable weights 440*a*, 440*b*, that are received in a first receiver or receptacle 442*a* and a second receiver or receptacle 442*b*, respectively. Similar to the arrangements described above, the adjustable weights 440*a*, 440*b* may have ends or portions that are weighted differently and may also be made from multiple weight members releasably connected together and having various weight values. In an exemplary embodiment, the first receiver is a first receiving tube 442*a*, and the second receiver is a second receiving tube 442*b*. The first receiving tube 442*a* has a vertical configuration positioned proximate the interface area 426 at a central location on the body 402, extending inwardly into the body 402 from an opening 443*a* at the sole 415. The second receiving tube 442*b* has a general horizontal configuration and extends from proximate the first receiving tube 442*a* and the interface area 426 towards the rear 412 of the club head 400. An end of the second receiving tube 442*b* is connected at the rear periphery of the club head 400. While two weights are being shown, it is understood that more or fewer weights may be used as desired. The first receiving tube 442*a* may be arranged at the base of the v-shaped void 430, and as shown in FIGS. 13-14, the interface area 426 supports the first receiving tube 442*a* generally at the junction of the first leg 422 and the second leg 424, such that the first leg 422 and the second leg 424 converge to the receiving tube 442. The first receiving tube 442*a* may be completely encased at the interface area 426 and/or may be supported by the interface area 426 and any internal structural reinforcement at the interface area 426. The first receiving tube 442*a* also has a recessed area 446*a* around the opening 443*a*, with sloping walls 449*a* sloping inwardly from the sole 415 to define the recessed area 448*a*.

In the embodiment of FIGS. 13-14, the second receiving tube 442*b* extends along the void 430 and has a space or gap 460 defined between the tube 442*a* and an underside surface 414*a* of the cover 450 or crown 414. An opening 443*b* into the second receiving tube 442*b* is positioned at an open end 463 proximate the rear 412 of the club head 400. The second receiving tube 442*b* also has a closed end 461 proximate the interface portion 426 and the open end 443*a* of the first receiving tube 442*a*. In this embodiment, the second receiving tube 442*b* is suspended at the closed end 461 by the interface portion 426 and is suspended at the open end 463 proximate the rear 412 of the club head 400, to space the receiving tube 442*b* from the underside 414*a* of the crown 414. The body 402 includes a rear rim 462 that extends between the ends of the legs 422, 424 and around a portion of the rear 412 of the club head 400, and the rear rim 462 combines with the legs 422, 424 and the interface area 426 to define the void 430. In this embodiment, the rear rim 462 supports and suspends the open end 463 of the second receiving tube 443*b*, such that the opening 443*b* is defined within the rear rim 462. The second receiving tube 442*b* also has a recessed area 448*b* around the opening 443*b*, with sloping walls 449*b* sloping inwardly from the rear rim 462 to define the recessed area 448*b*. As similarly described above, the second receiving tube 442*b* may have a window 445 to allow one to see the weight 440*b* in the tube 442*b*.

Similar to certain arrangements discussed above, the weights 440*a*, 440*b* are contained within the receiving tubes 442*a*, 442*b* in the golf club head 400. In some examples, the position of the weight 440*a*, 440*b* within the receiving tube may be maintained by fasteners 444, such as a screw or other threaded fastener. The receiving tubes may be visible, such as the second receiving tube 442*b* or may be contained within a portion of the golf club head 400 such that it is not visible from an exterior of the club, such as the first receiving tube 442*a*.

The weights 440*a*, 440*b* may be rotatable, removable, adjustable, etc. to adjust the performance characteristics of the golf club head. For example, adjustment of the second weight 440*b* may adjust the weight distribution and CG of the golf club head 400 in a front to rear direction. That is, positioning a heavier end of the second weight 440*b* near interface area 426 will adjust the overall weight and CG of the club head 400 toward a front 410 or face 411 of the golf club head 402. Alternatively, positioning a heavier end of the second weight 440*b* toward the rear 412 of the golf club head 400 may shift the overall weight and CG of the club head 400 toward the back or rear 412 of the golf club head 400.

The first weight 440*a* may also be adjustable, removable, rotatable, etc. to adjust the overall weight characteristics of the golf club head 400. For instance, adjustment of the first weight 440*a* may adjust the weight distribution and CG of the golf club head 400 in a high to low direction. That is, inserting the heavier end in first (i.e., positioning the heavier end toward the crown 414 since the first receiving tube 442*a* is accessed from the sole 415 of the golf club head 400) may adjust the overall weight and CG toward the crown 414 of the golf club head 400. Alternatively, inserting the lighter end in first (i.e., toward the crown 414) will adjust the overall weight and CG toward the bottom or sole 415 of the golf club head 400.

The weights 440*a*, 440*b* may be adjusted independently of each other. As described above, adjustment, rotation, etc. of the weights 440*a*, 440*b* may move or adjust the center of gravity of the golf club head 400 as desired. The hybrid arrangement of adjusting weight in both a fore/aft direction and high/low or sole/crown direction may provide for further customization of the weighting and/or performance characteristics of the golf club head 400. It is also understood that the receiving tubes 442*a*, 442*b* could be supported by pivotable supports providing further adjustment capabilities. It is further understood that the receivers or receptacles 442*a*, 442*b* have generally longitudinal axes, and the weights 440*a*, 440*b* are received along the longitudinal axes. In the embodiment of FIGS. 13-14, the longitudinal axis of the second receiving tube 442*b* and the second weight 440*b* is generally transverse to the ball striking face 411. In this embodiment, the longitudinal axis of the first receiving tube 442*a* and the first weight 440*a* is generally parallel to the ball striking face 411. In still other structures, either or both of these longitudinal axes can be positioned at an oblique angle with respect to the ball striking face 411.

Several different embodiments of the golf club head of the present invention have been described herein. The various embodiments have several different features and structures providing benefits and enhanced performance characteristics. It is understood that any of the various features and structures may be combined to form a particular club head of the present Invention.

The structures of the golf club heads disclosed herein provide several benefits. The unique geometry of the golf club head provides for beneficial changes in mass properties of the golf club head. The geometric weighting features provide for reduced weight and/or improved weight redistribution. The void defined in the club head can reduce overall weight as material is removed from a conventional golf club head wherein a void is defined in place of such material that would normally be present. The void also aids in strategically distributing weight throughout the club head to order to provide improved performance characteristics. The void provides for distributing weight to the rear corners of the club head, at the toe and the heel. Increases in moment of inertia have been achieved while optimizing the location of the center of gravity of the club head. This can provide a more forgiving golf club head as well as a golf club head that can provide more easily lofted golf shots. In certain exemplary embodiments, the weight associated with the portion of the golf club head removed to form the void may be approximately 4-15 grams and more particularly, 8-9 grams. In other exemplary embodiments, this weight savings may be redistributed to other areas of the club head such as towards the rear at the toe and the heel. In certain exemplary embodiments, approximately 2% to 7.5% of the weight is redistributed from a more traditional golf club head design. In still further examples, the void may be considered to have a volume defined by an imaginary plane extending from the sole surfaces and rear of the club and to cooperate with the side surfaces of the legs and underside portion of the cover. The internal cavity may also have a certain volume. The volumes are dimensioned to influence desired performance characteristics. It is further understood that certain portions of the club head can be formed from alternative materials to provide for weight savings or other weight redistribution. In one exemplary embodiment, the walls defining the void may be made from other materials such as composites or polymer based materials.

As discussed, the weight can be redistributed to more desired locations of the club head for enhanced performance. For example, with the centrally-located void and the legs extending outwardly towards the rear on the heel side and the toe side, more weight is located at such areas. This provides more desired moment of inertia properties. In the designs described herein, the moment of inertia (MOI) about a vertical axis (z-axis) through the center of gravity of the club head (Izz) can range from approximately 1500 gm-cm$^2$ to 5900 gm-cm$^2$ depending on the type of golf club. In an exemplary embodiment for a driver type golf club, the moment of inertia about a vertical axis (z-axis) through the center of gravity of the club head (Izz) can range from approximately 3800 gm-cm$^2$ to 5900 gm-cm$^2$, and in a further exemplary embodiment, the Izz moment of inertia can range from 4300 gm-cm$^2$ to 5200 gm-cm$^2$. In an exemplary embodiment of a fairway wood type golf club, the moment of inertia about a vertical axis (z-axis) through the center of gravity of the club head (Izz) can range from approximately 2000 gm-cm$^2$ to 3500 gm-cm$^2$, and in a further exemplary embodiment, the Izz moment of inertia can range from 2200 gm-cm$^2$ to 3000 gm-cm$^2$. In an exemplary embodiment of a hybrid type golf club, the moment of inertia about a vertical axis (z-axis) through the center of gravity of the club head (Izz) can range from approximately 2000 gm-cm$^2$ to 3500 gm-cm$^2$, and in a further exemplary embodiment, the Izz moment of inertia can range from 2200 gm-cm$^2$ to 3000 gm-cm$^2$, and in a further exemplary embodiment, the Izz moment of inertial can range from 1800 gm-cm$^2$ to 2800 gm-cm$^2$. In a particular embodiment utilizing the adjustable connection mechanism in the hosel, the Izz moment of inertia is approximately 4400 gm-cm$^2$ to 4700 gm-cm$^2$. These values can vary. With such moment of inertia properties, improved ball distance can be achieved on center hits. Also, with such moment of inertia properties, the club head has more resistance to twisting on off-center hits wherein less distance is lost and tighter ball dispersion is still achieved. Thus, a more forgiving club head design is achieved. As a result, golfers can feel more confident with increasing their golf club swing speed.

In addition, the center of gravity of the club head can be positioned at a location to enhance performance, through strategic weighting as described herein. In the structures of the exemplary embodiments of the golf club head, the center of gravity is positioned outside of the void location of the club head, and inside the internal cavity or internal volume of the club head. In certain exemplary embodiments, the center of gravity is located between an inner surface of the ball striking face and an inner surface of the base support wall, or within the internal cavity.

In addition, the geometry and structure of the golf club head provides enhanced sound characteristics. In certain embodiments, the first natural frequency of the golf club head, other than the six rigid body modes of the golf club head, may be in the range of 2750-3200 Hz. In additional exemplary embodiments, the first natural frequency of the golf club head may be at least 3000 Hz. It has been found that golf club head structures providing such a frequency of less than 2500 Hz can tend to be displeasing to the user by providing undesirable feel including sound and/or tactical feedback. The structures provided herein provide for increased frequencies at more desirable levels.

In addition, the moveable weight mechanisms employed herein provide additional options for distributing weight providing further adjustability of moment of inertia and center of gravity properties. For example, embodiments described herein providing weights that can be further moved towards the rear of the club head at the heel and toe can provide more easily lofted golf shots. Weights can also be more towards the front of the club head to provide more boring shots, such as those desired in higher wind conditions. Weights can also be positioned more towards a crown or sole and/or a heel or toe of the golf club head in certain embodiments. Such moveable weighting features provide additional customization.

Finally, adjustable connection mechanisms can be used with the club heads to provide club head adjustability regarding face angle, loft angle and/or lie angle. The access opening as described above may provide access to such connecting structure or mechanisms. A further embodiment utilizing the adjustable connection mechanism described above allows the golfer to adjust parameters of the golf club such as loft angle of the golf club. Certain golfers desire a lower loft angle setting such as but not limited to 7.5 degrees, 8 degrees, or 8.5 degrees or even 9 degrees. Such low loft angle settings may provide lower ball spin at ball impact. The moveable weight mechanisms, such as shown in FIGS. 2-14 could be utilized to place a heavier weight low towards a sole of the golf club head. This weighting configuration can provide for increased ball spin at the low loft angle settings. Certain other golfers may desire a higher loft setting such as but not limited to 11 degrees, 11.5 degrees, 12 degrees or 12.5 degrees. Such high loft angle settings may provide higher ball spin at ball impact. The moveable weight mechanism could be utilized to place a heavier weight high towards the top of the golf club head. This weighting configuration can provide for reduced ball spin at the high loft angle settings. Additional moveable weight mechanisms such as provided in FIGS. 2-14 could provide combinations of high/low and fore/aft weighting configurations to affect performance characteristics and provide particular desired launch conditions at particular loft angle settings.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a golf club head body comprising:

a crown, a sole, a toe end, a heel end, a rear, a front comprising a ball striking face, and an interface area proximate a central region of the golf club head body, the golf club head body further comprising a first leg proximate the toe end extending away from the interface area toward the rear, and a second leg proximate the heel end extending away from the interface area toward the rear, wherein a void is defined between the first leg and the second leg, the golf club head body further defining a cover comprising at least a portion of the crown that extends over the void, wherein the golf club head body defines an internal cavity, and a center of gravity of the golf club head is positioned within the internal cavity of the golf club head, wherein the golf club head body defines a breadth dimension measured from the front towards the rear;

the void comprises a v-shape wherein the void has a first width proximate the interface area and a second width proximate the rear, the second width being greater than the first width;

the golf club head body further comprises two weight receivers, and wherein a first weight receiver has a vertical configuration positioned proximate the interface area, and a second weight receiver has a general horizontal configuration and extends from proximate the first weight receiver.

2. The golf club head of claim 1, wherein, the interface area is positioned at a range of 30%-60% of the breadth dimension, measured from the ball striking face.

3. The golf club head of claim 1, wherein, the first and second weight receivers are configured to receive first and second weights.

4. The golf club head of claim 1, wherein, the first and second weight receivers comprise a first weight receiving tube and a second weight receiving tube respectively.

5. The golf club head of claim 4, wherein, the first weight receiving tube is arranged at a base of the void, and the interface area supports the first weight receiving tube generally at a junction of the first leg and the second leg such that the first leg and the second leg converge to the first weight receiving tube and, the second weight receiving tube extends along the void and, a space or gap is defined between the first weight receiving tube and an underside of the cover or crown, and the second weight receiving tube has an opening positioned proximate the rear.

6. The golf club head of claim 5, wherein, the first weight and the second weight each have a heavier end and a lighter end, wherein each of first and second weights may be received within the first and second weight receivers respectively such that either the heavier end or the lighter end may be closest to the interface.

7. The golf club head of claim 6, wherein, the weights adjust a performance characteristic of the golf club head by selecting an adjustment characteristic from a group consisting of;

rotatable, removable, and adjustable.

8. The golf club head of claim 7, wherein, the second weight adjusts weight distribution and center of gravity of the golf club head in a front to rear direction.

9. The golf club head of claim 8, wherein, the first weight adjusts weight distribution and center of gravity of the golf club head in a high to low direction.

10. The golf club head of claim 9, wherein, the first and second weights are able to be adjusted independently of each other.

11. The golf club head of claim 1, wherein, the first leg defines a first side and the second leg defines a second side;

wherein the first side and the second side are in a confronting relation.

12. The golf club head of claim 11, wherein, the first side and the second side are generally planar and comprise a flat surface.

13. The golf club head of claim 11, wherein, the first side and the second side are non-planar and define interrupted non-flat surfaces.

14. The golf club head of claim 11, wherein, the first side and the second side both depend from an underside of the crown.

15. The golf club head of claim 1, wherein, the cover is formed as a single piece with the rest of the golf club head body.

16. The golf club head of claim 1, wherein, the cover is formed as a separate piece from the rest of the golf club head body and thereafter attached to the golf club head body.

17. The golf club head of claim 11, wherein, the first and second legs and the first and second sides converge towards the ball striking face to the interface area.

18. The golf club head of claim 11, wherein, the first and second sides and the interface area further comprise internal surfaces and outer surfaces;

wherein the internal surfaces comprise strength-enhancing structures.

* * * * *